US006861596B2

(12) United States Patent
Schnackenberg

(10) Patent No.: US 6,861,596 B2
(45) Date of Patent: Mar. 1, 2005

(54) SWITCH INTERLOCK APPARATUS

(75) Inventor: Paul Schnackenberg, Cumming, GA (US)

(73) Assignee: Gen-Tran Corporation, Roswell, GA (US)

( * ) Notice: Subject to any disclaimer, the term of this patent is extended or adjusted under 35 U.S.C. 154(b) by 0 days.

(21) Appl. No.: 10/446,303

(22) Filed: May 28, 2003

(65) Prior Publication Data

US 2004/0118667 A1 Jun. 24, 2004

Related U.S. Application Data

(63) Continuation-in-part of application No. 10/078,039, filed on Feb. 19, 2002, now abandoned.

(51) Int. Cl.[7] ..... H01H 9/28

(52) U.S. Cl. ..... 200/43.01; 200/43.11; 200/50.32

(58) Field of Search ..... 200/43.01, 43.11, 200/43.15, 50.01, 50.3, 50.32, 50.35

(56) References Cited

U.S. PATENT DOCUMENTS

| | | | | |
|---|---|---|---|---|
| 805,057 | A | 11/1905 | Craft | |
| 1,439,905 | A | 12/1922 | Lull | |
| 1,596,513 | A | 8/1926 | Ainsworth | |
| 1,863,627 | A | 6/1932 | Gray | |
| 2,348,107 | A | 5/1944 | Brongersma | |
| 2,531,157 | A | 11/1950 | Pifke | |
| 2,573,485 | A | 10/1951 | Pifke | |
| 2,606,260 | A | 8/1952 | Frese | |
| 2,646,474 | A | 7/1953 | Stratton | |
| 2,841,666 | A | 7/1958 | Anderson | |
| 2,879,348 | A | 3/1959 | Ortwig | |
| 2,888,615 | A | 5/1959 | Tusing | |
| 3,069,518 | A | 12/1962 | Soos | |
| 3,158,701 | A | 11/1964 | Nadeau | |
| 3,188,411 | A | 6/1965 | Luenser | |
| 3,198,898 | A | 8/1965 | Piteo, Jr. | |
| 3,277,251 | A | 10/1966 | Daly | |
| 3,284,591 | A | 11/1966 | Daly | |
| 3,319,020 | A | 5/1967 | Shaffer | |
| 3,342,958 | A | 9/1967 | Arneberg | |
| 3,432,628 | A | 3/1969 | Puetz | |
| 3,492,448 | A | 1/1970 | Phillips, Jr. | |
| 3,523,166 | A | 8/1970 | Daly | |
| 3,647,997 | A | 3/1972 | Nerem | 200/50 C |
| 3,703,614 | A | 11/1972 | Zubaty et al. | 200/50 C |
| 3,705,280 | A | 12/1972 | Harms | 200/50 C |
| 3,778,633 | A | 12/1973 | De Visser et al. | 307/64 |
| 3,808,451 | A | 4/1974 | Pittet | 307/64 |
| 4,270,031 | A | 5/1981 | Borona et al. | 200/50 C |
| 4,510,357 | A | 4/1985 | Winterbottom | 200/50 R |
| 4,590,387 | A | 5/1986 | Yoshida et al. | 307/64 |
| 4,665,284 | A | 5/1987 | Guinan | 200/50 C |
| 4,733,029 | A * | 3/1988 | Kobayashi et al. | 200/43.15 |
| 4,827,089 | A | 5/1989 | Morris et al. | 200/50 C |

(List continued on next page.)

FOREIGN PATENT DOCUMENTS

| | | |
|---|---|---|
| GB | 787469 | 12/1957 |

*Primary Examiner*—Kyung Lee
(74) *Attorney, Agent, or Firm*—Greenberg Traurig

(57) ABSTRACT

A switch interlock apparatus for use with switch panels that have pairs of functionally related switches, in which the handles for the switches are mounted in tandem and aligned with their pivot axes parallel to and spaced apart from one another, in which one of the switches must be flipped, before the other switch can be flipped. The switch interlock apparatus mechanically connects the handles of two functionally related switches so that as one switch moves from an "OFF" to an "ON" position, the interlock constrains the handle of the related paired switch to move from "ON" to "OFF" first. In a preferred embodiment, the switch interlock apparatus incorporates a monolithically formed interlock member that can be directly mounted to a switch panel without intermediate assembly steps.

20 Claims, 31 Drawing Sheets

U.S. PATENT DOCUMENTS 4,902,859 A 2/1990 Witzmann et al. ..... 200/50 C
4,906,958 A 3/1990 Adamson ..... 335/11
4,924,041 A 5/1990 Yee ..... 200/50 C
4,980,525 A 12/1990 Kakisako ..... 200/50 R
5,008,499 A 4/1991 Yee et al. ..... 200/50 C
5,019,676 A 5/1991 Heckenkamp ..... 200/50 A
5,070,252 A 12/1991 Castenschiold et al. ..... 307/64
5,109,142 A 4/1992 von Kannewurff et al. ..... 200/50 R
5,122,624 A 6/1992 Benda ..... 200/43.14
5,172,087 A 12/1992 Castonguay et al. ..... 335/160
5,189,385 A 2/1993 Gnahn ..... 335/132
5,206,776 A 4/1993 Bodenheimer et al. ..... 361/20
5,268,543 A 12/1993 Ramos ..... 200/443.11
5,270,503 A 12/1993 Frye ..... 200/43.14
5,310,969 A 5/1994 Turek et al. ..... 200/43.14
5,322,980 A 6/1994 Benda ..... 200/43.014
5,393,942 A * 2/1995 Reiner et al. ..... 200/50.4
5,418,675 A 5/1995 Bodenheimer et al. ..... 361/20
5,422,453 A * 6/1995 Smith et al. ..... 200/329
5,436,415 A 7/1995 Smith et al. ..... 200/50 C
5,508,670 A 4/1996 Mantzouridis et al. ..... 335/172
5,515,235 A 5/1996 Stoller ..... 361/605
5,543,595 A 8/1996 Mader et al. ..... 200/401
5,557,082 A 9/1996 Leet et al. ..... 200/50.35
5,648,646 A 7/1997 Flegel ..... 200/50.32
5,790,369 A 8/1998 Sitler ..... 361/643
5,817,999 A 10/1998 Mugan et al. ..... 200/50.11
5,874,698 A * 2/1999 Collis ..... 200/50.33
5,902,974 A 5/1999 Fogle et al. ..... 200/50.33
5,929,405 A 7/1999 Wehrli, III et al. ..... 200/50.01
5,978,209 A * 11/1999 Montague et al. ..... 361/634
6,002,579 A 12/1999 Drexler et al. ..... 361/605
6,028,273 A 2/2000 Osborn, Jr. ..... 200/51.09
6,031,193 A 2/2000 Flegel ..... 200/50.33
6,043,439 A * 3/2000 Crooks et al. ..... 200/50.33
6,069,328 A 5/2000 Oravetz et al. ..... 200/50.33
6,096,986 A 8/2000 Flegel ..... 200/50.33
6,137,070 A 10/2000 Montague et al. ..... 200/50.35
6,169,340 B1 1/2001 Jones ..... 307/64
6,180,897 B1 1/2001 Montague et al. ..... 200/50.35
6,184,595 B1 2/2001 Flegel, Jr. ..... 301/114
6,320,143 B1 11/2001 Greer ..... 200/50.33
6,424,060 B1 7/2002 Shiely et al. ..... 307/328

* cited by examiner

SWITCH INTERLOCK APPARATUS

This application is a continuation-in-part and claims priority of Ser. No. 10/078,039, filed Feb. 19, 2002, and presently abandened.

BACKGROUND OF THE INVENTION

1. Field of the Invention

The present invention relates to switch interlock apparatus, such as are used with switch panels, like electrical breaker switch panels, wherein the switches are arrayed in pairs.

2. The Prior Art

Switching apparatus, such as breaker switch panels, that have switches that are arrayed in pairs, are known. Typically, the individual switches in such switch apparatus are laid out in such a manner that switches that are connected to related circuits are arranged in horizontal pairs, wherein in order to accomplish a particular switching operation, it is either desirable or absolutely necessary that one switch be flipped (opened or closed) before a second switch of a functional pair is flipped (closed or opened). Together, such a switch functional pair is often referred to collectively as a "break-before-make" switch.

One such environment in which such "break-before-make" switch combinations are used is a transfer switch panel. Transfer switches are switches or groups of switches that are used to convert a powered circuit, such as a residential or commercial structure, from one source of electrical current, to another source of current. One typical example is a residential structure that is provided with an independently powered back-up electrical generator. A transfer switch or switch panel will be connected to the household circuits, the utility power connection, and to the input from the generator.

If the transfer switch is manual, upon failure of the utility power, an operator will flip the transfer switches, disconnecting the utility current source from the household circuitry and connecting the back-up generator to the household circuitry. The generator is then started (or may have already been started) and back-up current is supplied to the residence.

If the transfer switch is of the automatic type, it will monitor various characteristics of the utility power being supplied, and if one or more of the characteristics falls below a predetermined numerical value, a similar sequence of switches will be automatically flipped through an automated mechanism, and the generator (if provided with an electric starter circuit) will be automatically started.

For manual transfer switches, typically, physically separate switches are used for each functional switch pair, in two columns of switches. Typically, such switches are biased, so that once a switch handle has reached top dead center, any slight deflection from that position, will cause the switch to continue to the full switched position on that "side" of top dead center, unless otherwise restrained.

The reason that separately acting switches are used is to ensure that the utility current circuitry is disengaged before the power is applied, to prevent power from being fed back into the utility current source circuit, potentially causing substantial damage to utility equipment and/or personal injury. In addition, typically, the polarities of the switches in the respective columns are reversed. For example, in a switch panel having two columns of switches, the individual switches of one column of switches must be flipped first before the corresponding individual switches of the column of switches can be flipped. For example, in the left-hand column, which may be the switches for connecting the back-up generator circuit to the household circuit, the "ON" positions for the switch handles will be on the right and the "OFF" positions for the switch handles will be on the left. In the right-hand column, which may be the switches for connecting the line/utility circuit to the household circuit, the "OFF" positions will be to the right, and the "ON" positions will be to the left. In such an arrangement, the switches on the right must be flipped before the corresponding ones on the left can be safely flipped. However, there may be a tendency for an operator to make a single left-to-right hand movement would flip all the left column switches from "ON" to "OFF", and then flip all the right column switches from "OFF" to "ON". In such a situation, the order of switching would be improper, and could lead to damage or personal injury.

Therefore it has been determined that it is not only desirable but necessary to ensure that the switches engaging the generator to the household circuit cannot be flipped, before the line/utility is disconnected from the household circuit. By advantageously connecting the switch handles together, it is ensured that if a generator switch is flipped, the corresponding line/utility switch will be flipped first.

Interlock devices for connecting the handles of such functional pairs of switches are known. One such device is disclosed in Flegel, U.S. Pat. No. 6,031,193. The apparatus that is disclosed in the Flegel '193 patent comprises two flat metal plates that are connected together by a "U"-shaped metal piece that has two upturned ends. The bottom of the "U" has a series of holes through which screws may be passed, and in turn, passed through holes in the ends of the two flat metal plates (for adjustability). The distance between the upturned ends (stops) of the U-shaped metal piece is about the distance between the inside faces of the switches, when one is in the "OFF" position and the other is in the "ON" position. The interlock is assembled in place, with the two flat bars being slid through recesses or apertures beneath the cross bars of the individual opposed switch handles, and then connected to each other via the "U"-shaped component. Screws are placed in holes in the opposite ends of the interlock (to the outside of the two switches), the ends of which are intended to ride in slots (presumably already provided in the face of the switch panel) between the pairs of tandem switches, as an additional guide arrangement. The stops on the U-shaped metal piece are spaced so that when a switch in the "OFF" position is being moved toward the "ON" position, the switch in the "ON" position is moved to top dead center and then into its over-center position and switches, under bias, to "OFF" before the first switch arrives at its respective "ON" position.

However, such a design has several potential limitations. First, it must be assembled in place from component parts, thus making it somewhat awkward and labor intensive to install. Second, it requires that each of the switch handles actually be a tandem (side-by-side) handle, so that there is a gap or hole, through which the main bar of the interlock has to be passed. Third, the design requires the presence of a groove or rail, into which the ends of the screws are received, to act as a guide for the reciprocating movement of the interlock apparatus.

It would be desirable to provide a switch interlock apparatus that has a simplified structure that does not require assembly of numerous component parts.

It would also be desirable to provide a switch interlock apparatus that can be pre-assembled prior to mounting to a switch panel.

It would also be desirable to provide a switch interlock apparatus that does not depend upon structural features of the switch panel to which it is being mounted, such as a groove or rail, for functionality.

These and other desirable characteristics of the present invention will become apparent in view of the present specification, including claims, and drawings.

SUMMARY OF THE INVENTION

The present invention is directed to a switch interlock apparatus, for mechanically connecting the handles of functionally and physically paired switches on a switch panel. The switch interlock apparatus comprise an elongated interlock member, having a longitudinal axis and first and second ends. At least one fastener structure is disposed on the elongated interlock member, for enabling slidable connection of the elongated interlock member to a switch panel. A switch handle receiving contour is disposed at each of the first and second ends of the elongated interlock member. A switch handle engagement surface is disposed within each switch handle receiving contour.

In a preferred embodiment of the invention, the switch interlock apparatus further comprises guide structure, operably associated with the at least one fastener structure, for constraining the slidable movement of the elongated interlock member to linear reciprocating movement.

In a preferred embodiment of the invention, the at least one fastener structure comprises at least one aperture through the elongated interlock member, for accommodating the passage of a fastener therethrough. When a guide structure is provided, in a preferred embodiment of the invention, the guide structure comprises the at least one aperture being formed as an elongated slot extending parallel to the longitudinal axis of the elongated interlock member.

Preferably, the switch handle receiving structure disposed at each end of the elongated interlock member comprises a substantially rectangular notch.

Preferably, the distance between the switch handle engagement surfaces is less than an inside-to-inside distance between the handles of functionally and physically paired switches on a switch panel.

Preferably, the elongated interlock member is monolithically formed from a single piece of material. In an embodiment of the invention, the elongated interlock member is formed from metal. In another embodiment of the invention, the elongated interlock member is formed from plastic.

In another embodiment of the invention, the switch interlock apparatus may further comprise a lateral stabilization contour disposed between the first and second ends of the elongated interlock member. The lateral stabilization contour may comprise a ridge extending transversely across the elongated interlock member, substantially perpendicular to the longitudinal axis. Alternatively, the lateral stabilization contour comprises at least two longitudinally extending ridges emanating from the elongated interlock member and extending substantially parallel to the longitudinal axis.

The present invention is also directed, in part, to a switch interlock apparatus, for functionally interconnecting the handles of functionally and physically paired switches mounted in tandem on a switch panel, the switch panel having a front face and a housing portion disposed distal to the front face, wherein the handles are arranged in tandem to pivot in a common plane about parallel, spaced apart axes, such that when each handle is in its respective "OFF" position, the handles are pivoted away from one another and when each handle is in its respective "ON" position, the handles are pivoted toward one another, in which the switch interlock apparatus comprises an elongated interlock member, having a longitudinal axis and first and second ends. At least one fastener structure is disposed on the elongated interlock member, for enabling slidable mounting of the elongated interlock member in juxtaposed relation to the front face of a switch panel. A switch handle engagement surface is disposed on each end of the elongated interlock member.

A mounting bracket is operably configured to be attached to a switch panel housing, for slidably mounting the elongated interlock member in said juxtaposed relation to the front face of a switch panel, without attachment of the elongated interlock member to the front face, the mounting bracket further being operably configured for restrainably maintaining functionally and physically paired switches on a switch panel.

In an embodiment of the invention, the elongated interlock member comprises a substantially U-shaped member, including a substantially planar elongated portion having two ends, and an upraised switch handle engaging leg at each end. The at least one fastener structure may comprise an elongated slot in the substantially planar longitudinal portion of the interlock member. The mounting bracket may comprise an interlock member support leg operably configured to extend across the front face of a switch; and an attachment leg, at least indirectly connected thereto, configured for attachment to a switch housing. The interlock member support leg may further comprise at least one stabilizer bar emanating from a side edge of the interlock member support leg, operably configured for bearing against a front face of a switch, toward preventing twisting of the interlock member support leg relative to said front face.

The invention also comprises, in part a switch interlock apparatus, for functionally interconnecting the handles of functionally and physically paired switches mounted in tandem on a switch panel, the switch panel having a front face and a housing portion disposed distal to the front face, wherein the handles are arranged in tandem to pivot in a common plane about parallel, spaced apart axes, such that when each handle is in its respective "OFF" position, the handles are pivoted away from one another and when each handle is in its respective "ON" position, the handles are pivoted toward one another, wherein the switch interlock apparatus comprises a mounting frame, operably configured to interlockingly engage peripheral regions of front faces areas of physically paired switches, without the use of separate fasteners. A mounting post is disposed on the mounting frame. An interlock member is slidably mounted on the mounting post for reciprocating movement relative to the mounting frame, and configured so that when the mounting frame is mounted on the faces of paired switches, the switch handles are precluded from simultaneously occupying their respective "ON" positions, and movement of a first switch handle from its "OFF" position, toward its "ON" position, causes the interlock member to push a second switch handle from its "ON" position, to its "OFF" position, prior to the first switch handle arriving at its "ON" position.

The interlock member may have a shape in the form of a "U"-shaped channel, comprising a planar central web and two planar leg webs extending substantially perpendicular thereto, the central web having an elongated slot therein. In one embodiment of the invention, the mounting post is hollow and internally threaded, and a fastener extends through the elongated slot and into a complementary fastener receiving aperture disposed in the mounting post. In an alternative embodiment, the mounting post is externally threaded and extends through the elongated slot, and a fastener in the form of an internally threaded nut maintains the interlock member in position. At least two guide members may be disposed on the mounting frame at transversely spaced apart positions, so that the mounting post is disposed substantially equidistantly between the at least two guide members, for guiding the interlock member during its reciprocating movement.

In a preferred embodiment of the invention, at least one resiliently movable spring clip member is operably disposed on the mounting frame for interlockingly engaging a peripheral portion of a switch face.

The interlock member may be in the configuration of an elongated "U"-shaped channel, in which the "U"-shaped channel is inverted relative to the mounting post, so that the mounting post extends between the leg webs, and in which the "U"-shaped channel is oriented such that the leg webs extend longitudinally, with respect to an axis extending between the switch handles, when the switch interlock apparatus is mounted on a pair of switches arranged in tandem, wherein end edge portions of the central web of the "U"-shaped channel engage the switch handles during reciprocating movement of the interlock member. Alternatively, the interlock member may be in the configuration of a widened, truncated "U"-shaped channel, in which the channel is oriented such that the leg webs extend transversely with respect to an axis extending between the switch handles, when the switch interlock apparatus is mounted on a pair of switches arranged in tandem, wherein portions of the leg webs of the "U"-shaped channel engage the switch handles during reciprocating movement of the interlock member.

The invention also comprises, in part, a switch interlock apparatus, for functionally interconnecting the handles of functionally and physically paired switches mounted in tandem on a switch panel, the switch panel having a front face and a housing portion disposed distal to the front face, wherein the handles are arranged in tandem to pivot in a common plane about parallel, spaced apart axes, such that when each handle is in its respective "OFF" position, the handles are pivoted away from one another and when each handle is in its respective "ON" position, the handles are pivoted toward one another, wherein the switch interlock apparatus comprises a mounting frame, operably configured to interlockingly engage peripheral regions of front faces areas of physically paired switches, without the use of separate fasteners. An interlock member is slidably mounted relative to the mounting frame for reciprocating movement relative thereto, and configured so that when the mounting frame is mounted on the faces of paired switches, the switch handles are precluded from simultaneously occupying their respective "ON" positions, and movement of a first switch handle from its "OFF" position, toward its "ON" position, causes the interlock member to push a second switch handle from its "ON" position, to its "OFF" position, prior to the first switch handle arriving at its "ON" position. An interlock member mounting and guide structure is operably disposed on the mounting frame, for enabling capture of the interlock member between the interlock member mounting and guide structure, and front face surfaces of the mounted in tandem switches and facilitating reciprocating longitudinal movement of the interlock member, when the switch interlock apparatus is mounted on the mounted in tandem switches.

In this embodiment, the interlock member has a shape in the form of a "U"-shaped channel, comprising a central web and two planar leg webs extending substantially perpendicular thereto, the central web having an elongated slot therein. At least one resiliently movable spring clip member is operably disposed on the mounting frame for interlockingly engaging a peripheral portion of a switch face. The interlock member is preferably in the configuration of a widened, truncated "U"-shaped member, in which the member is oriented such that the leg webs extend transversely with respect to an axis extending between the switch handles, when the switch interlock apparatus is mounted on a pair of switches arranged in tandem, wherein portions of the leg webs of the "U"-shaped channel engage the switch handles during reciprocating movement of the interlock member.

In an alternative embodiment of the invention, a switch interlock apparatus is provided, for functionally interconnecting the handles of functionally and physically paired switches mounted in tandem on a switch panel, the switch panel having a front face and a housing portion disposed distal to the front face, wherein the handles are arranged in tandem to pivot in a common plane about parallel, spaced apart axes, such that when each handle is in its respective "OFF" position, the handles are pivoted away from one another and when each handle is in its respective "ON" position, the handles are pivoted toward one another, in which the switch interlock apparatus comprises an interlock member, the interlock member having an elongated central planar web having a longitudinal axis, the interlock member configured to be mounted relative to the mounted in tandem switches such that the longitudinal axis of the central planar web extends parallel to an axis extending between the switch handles, when the switch interlock apparatus is mounted on a pair of switches arranged in tandem. The interlock member further has two "L"-shaped leg webs extending from opposite ends of the central planar web, each leg web including a truncated connecting web portion extending at an angle to the central planar web, and a switch handle engaging web portion, extending substantially parallel to the central planar web.

In an embodiment for use when the switch panel has a front face and a housing portion disposed distal to the front face, the switch interlock apparatus further comprises a mounting bracket operably configured to be attached to a switch panel housing, for slidably mounting the elongated interlock member in said juxtaposed relation to the front face of a switch panel, without attachment of the elongated interlock member to the front face, the mounting bracket further being operably configured for restrainably maintaining functionally and physically paired switches on a switch panel.

Alternatively, the switch interlock member may be mountable directly to front face surfaces of the mounted in tandem switches, for slidable movement relative thereto.

DETAILED DESCRIPTION OF THE DRAWINGS

Figure 1:
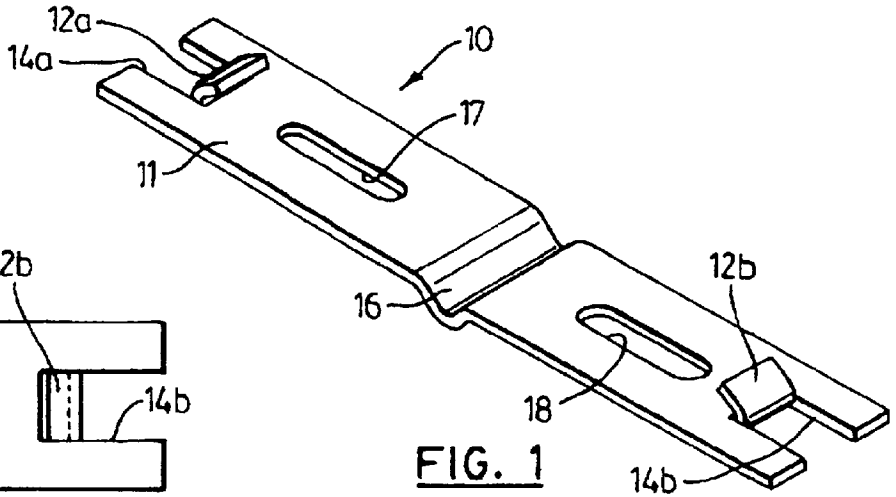
FIG. 1 is a perspective view of the switch interlock apparatus according to one embodiment of the invention.

While this invention is susceptible of embodiment in many different forms, there is shown in the drawings and will be described in detail, two specific embodiments, with the understanding that the present disclosure is to be considered as an exemplification of the principles of the invention and is not intended to limit the invention to the embodiment illustrated.

Any dimensions or other numerical values which may be indicated in the Figures or in the description herein are by way of example, and the invention is not to be considered limited thereto.

Figure 2:
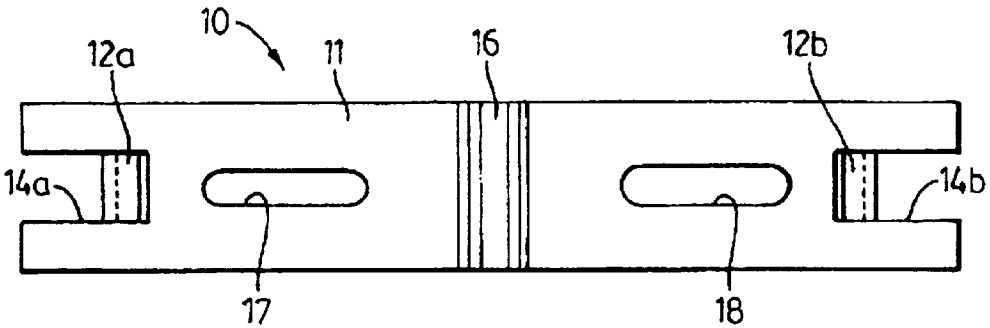
FIG. 2 is a top plan view of a switch interlock apparatus according to one embodiment of the invention.
Figure 3:
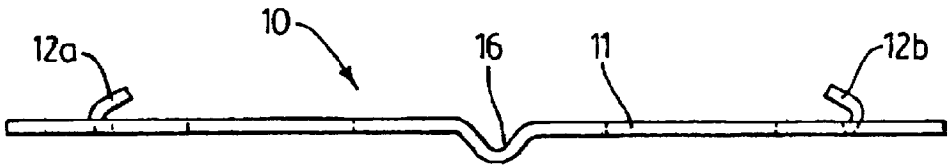
FIG. 3 is a side elevation of the switch interlock apparatus according to the embodiment of FIG. 1.
Figure 4:
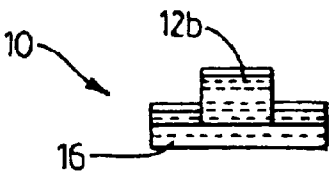
FIG. 4 is an end elevation of the switch interlock apparatus according to the embodiment of FIG. 1.
Figure 5:
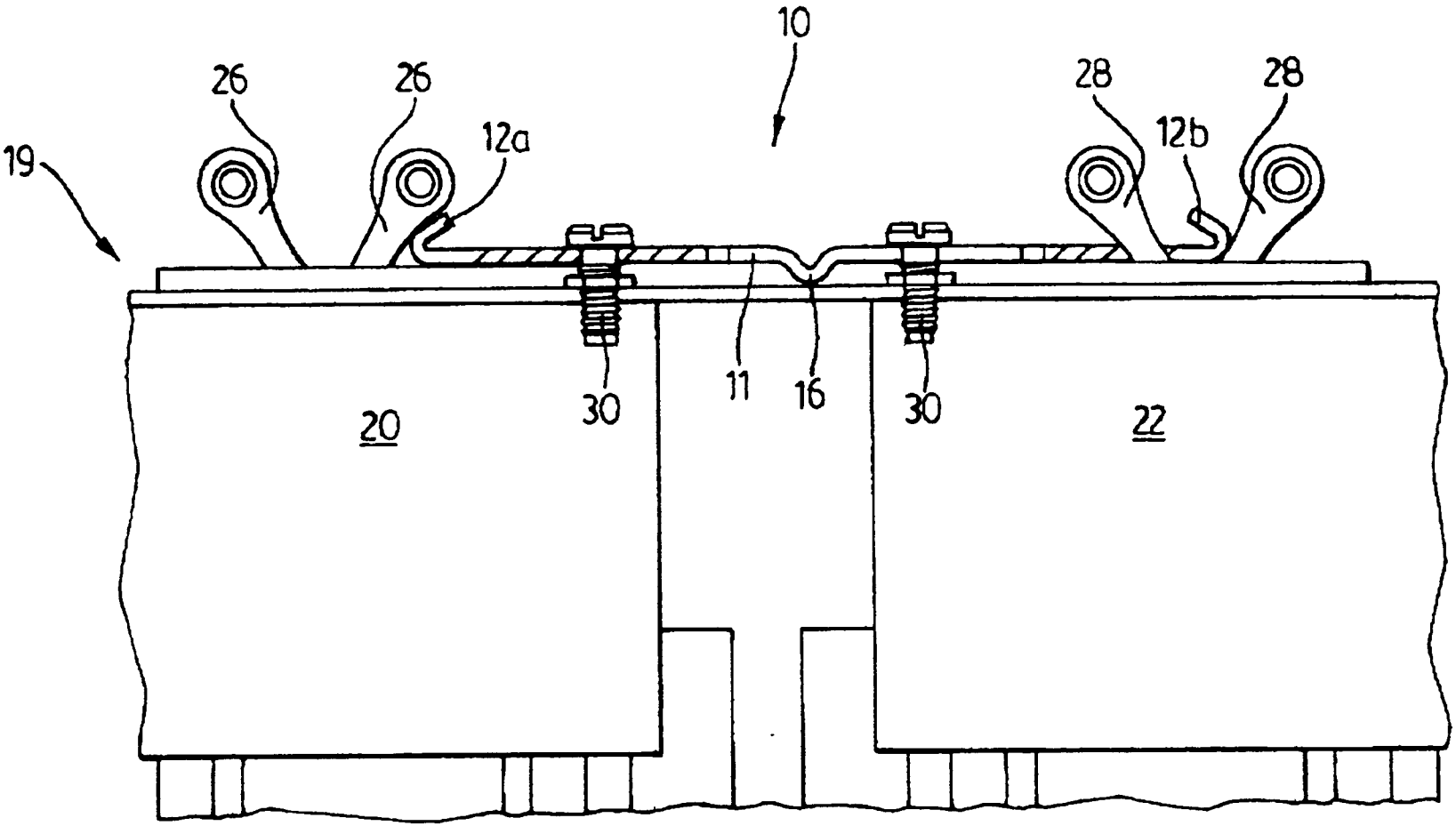
FIG. 5 is a side elevation of the switch interlock apparatus according to the embodiment of FIGS. 1–4, showing the switch interlock apparatus in position on a switch panel, in first and second positions relative thereto.

FIGS. 1–5 illustrate a first embodiment of the invention. FIG. 1 is a perspective view of a reciprocating interlock member of a switch interlock apparatus according to one embodiment of the invention. FIG. 2 is a top view of the reciprocating interlock member. FIG. 3 is a side elevation of the reciprocating interlock member. FIG. 4 is an end view, and FIG. 5 is a side elevation of the switch interlock apparatus according to the embodiment of FIGS. 1–4, showing the switch interlock apparatus in position on a switch panel, in first and second positions relative thereto.

The first embodiment for switch interlock apparatus 10 comprises an originally flat elongated interlock member 11 that has a rectangular tab cut from each end, and curled upward to create a switch handle stop 12*a*, 12*b* and a rectangular notch 14*a*, 14*b*, one at each end of the elongated interlock member 11. Elongated interlock member 11 is preferably monolithically formed as a single piece of metal, preferably steel. Elongated interlock member 11 has been further deformed by the introduction of a generally V-shaped transverse ridge/notch 16. Ridge 16 provides for lateral stabilization of the elongated interlock member 11, so that it has less tendency to rock from side to side, during operation.

Referring to FIG. 5, two aligned switches 20, 22, e.g., circuit breakers for a transfer switch panel 19 (typically there are several such pairs of switches/circuit breakers), are mounted, in usual fashion, so that the "OFF" positions for the handles are to the outside of the pair of breakers and the "ON" positions are to the inside. Switch 20 has a single handle 26, which is shown in both its "OFF" (left) and "ON" (right) positions. Switch 22 has a single handle 28, which is shown in both its "ON" (left) and "OFF" (right) positions. The distance between the tabs 12*a*, 12*b* in the elongated interlock member 11 is actually slightly more than the inside face to inside face distance between switch handles 26, 28, when one switch is in the "OFF" position, and the other switch is in the "ON" position. The curled up portions of tabs 12*a* and 12*b* bear against the inside surfaces of the two aligned switch handles 26, 28. Slots 14*a*, 14*b* accommodate handles 26, 28, so that handles 26, 28 are surrounded by the portions of elongated interlock member 11 that are to the sides (or above and below, depending upon the orientation of the switch panel) of handles 26, 28. The portions of elongated interlock member 11 that are to the sides of handles 26, 28 are omitted from FIG. 5, for simplicity of illustration.

Elongated interlock member 11 has two longitudinally extending slots 17, 18. Each of switches 20, 22 will already have openings for receiving screws, as those will be the openings used for affixing the faces of the switches to the switch body, which is an industry standard construction. Elongated interlock member 11 is slidably mounted with respect to the face of the panel 19, by inserting one screw 30 through each slot, so that the elongated interlock member 11 is guided in its reciprocating movement by the screws 30 interacting with slots 17, 18. Stability and smoothness of movement is provided, in part, by transverse ridge/notch 16, as well as the flat portions of the ends of elongated interlock member 11, which rest directly against the portions of switches 20, 22, that are immediately adjacent handles 26, 28. Because notches 14*a*, 14*b* are open ended, this design does permit both switches to be in the "OFF" position, but not both in the "ON" position, because the distance between tabs 12*a*, 12*b* is less than the inside-to-inside distance between handles 26, 28. Typical switch panels usually have faces that are immediately adjacent the handles for functionally and physically paired switches, that are elevated with respect to the space or at least a portion of the space between the switches. When fastened to switch panel 19, the screws are used, not to press apparatus 10 hard again these face surfaces, but rather to generally keep apparatus 10 in close proximity, but with freedom of reciprocating linear movement between the handles of the switches.

Mounting of apparatus 10 is accomplished by simply flipping the handles of paired switches to their respective "OFF" positions (i.e., away from one another) ensuring of course, that the circuits are "dead" to avoid injury or damage, and fastening apparatus 10 using screws or machine bolts, into already existing or formed apertures.

FIGS. 6–13 illustrate a second preferred embodiment of the invention. Switch interlock apparatus 50 is preferably a monolithically-formed, molded plastic structure that otherwise has generally the same configuration as the first embodiment, in that it has two open notches at opposite ends of the molding, and two longitudinal slots for receiving and interacting with the mounting and guide screws.

Figure 6:
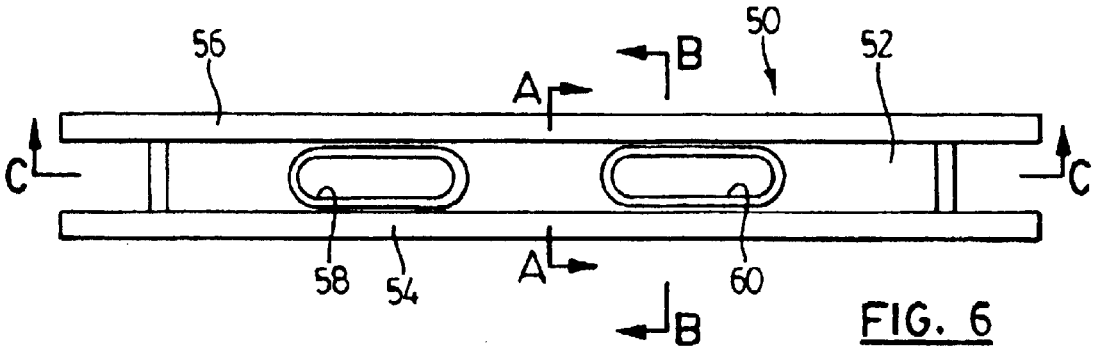
FIG. 6 is a top plan view of a switch interlock apparatus according to a another embodiment of the invention.

FIG. 6 is a top plan view of a switch interlock apparatus 50 according to a second embodiment of the invention. Preferably, switch interlock apparatus 50 is fabricated from a single piece of molded plastic material, such as flame resistant ABS or polycarbonate 94VO, or other similar material that has the characteristics of durability, fire resistance and UL (Underwriter's Laboratories) acceptability (a requirement for products for commercial or residential installation). Switch interlock apparatus 50 includes a central "horizontal" web 52, and two "vertical" side webs 54, 56. Two elongated slots 58, 60 are provided in web 52. Each of slots 58, 60 may have suitably formed inside surface contours, so that when switch interlock apparatus 50 is connected to a switch panel, e.g., by screws, the heads of the screws will be received in upper, widened portions of the slots, while the threaded portions of the screws will be received in lower, narrower portions of the slots. See, e.g., FIG. 9. Each of side webs 54,56 includes two downwardly extending ridges, e.g., ridges 62, 64 of side web 54, and ridges 66, 68 (see FIG. 7) which serve to "elevate" switch interlock apparatus 50, so that the ridges contact the recessed portions of a switch panel 79 (see FIGS. 12, 13), while the ends of switch interlock apparatus 50 are flush with the portions of the switches that are immediately adjacent the switch handles. Ridges 62, 64, 66, 68 provide for lateral stabilization of switch interlock apparatus 50, much as ridge 16 does for switch interlock apparatus 10. Ridges 62, 64, 66 and 68 also serve to "elevate" the ends of the interlock apparatus 50, in a manner similar to the way ridge 16 "elevates" the ends of apparatus 10.

Switch interlock apparatus 50 includes notches 70, 72 at its ends, with notch bottoms 74, 76, respectively. The distance between notch bottoms 74, 76 is, as in the embodiment of FIGS. 1–5, less than the inside-to-inside distance between paired switch handles, again, so that while the two handles can both be in the "OFF" position, two handles of paired switches cannot be in the "ON" position.

Figure 7:
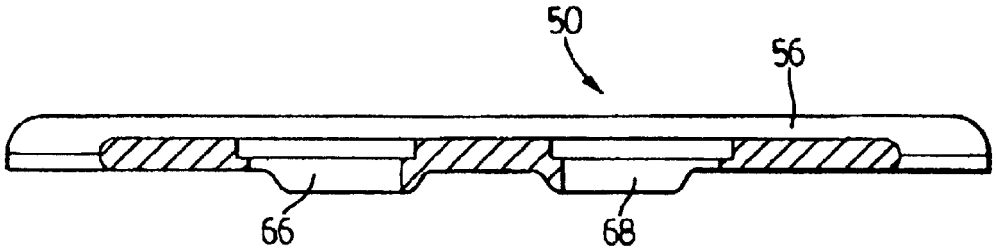
FIG. 7 is a side elevation, partially in section, of the switch interlock apparatus according to the embodiment of FIG. 6, taken along line C—C of FIG. 6.
Figure 8:
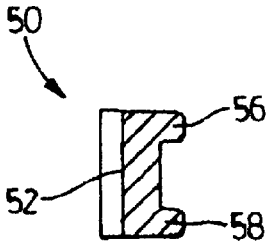
FIG. 8 is an end view, in section, of the switch interlock apparatus according to the embodiment of FIGS. 6–7, taken along line A—A of FIG. 6.
Figure 9:
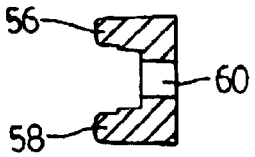
FIG. 9 is an end view, in section, of the switch interlock apparatus according to the embodiment of FIGS. 6–8, taken along line B—B of FIG. 6.
Figure 10:
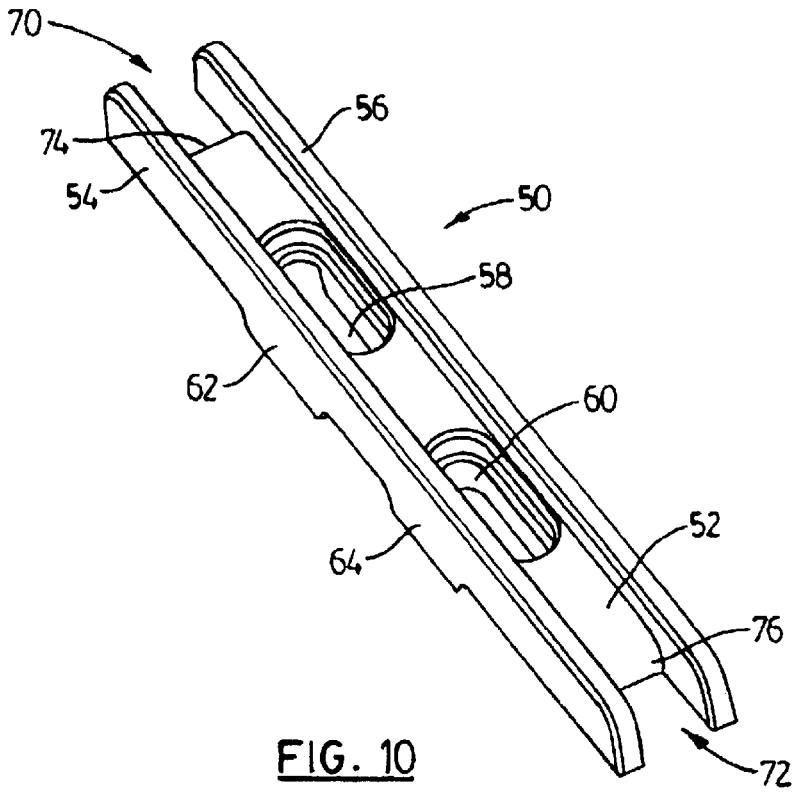
FIG. 10 is a top perspective view of the switch interlock apparatus according to the embodiment of FIGS. 6–9.
Figure 11:
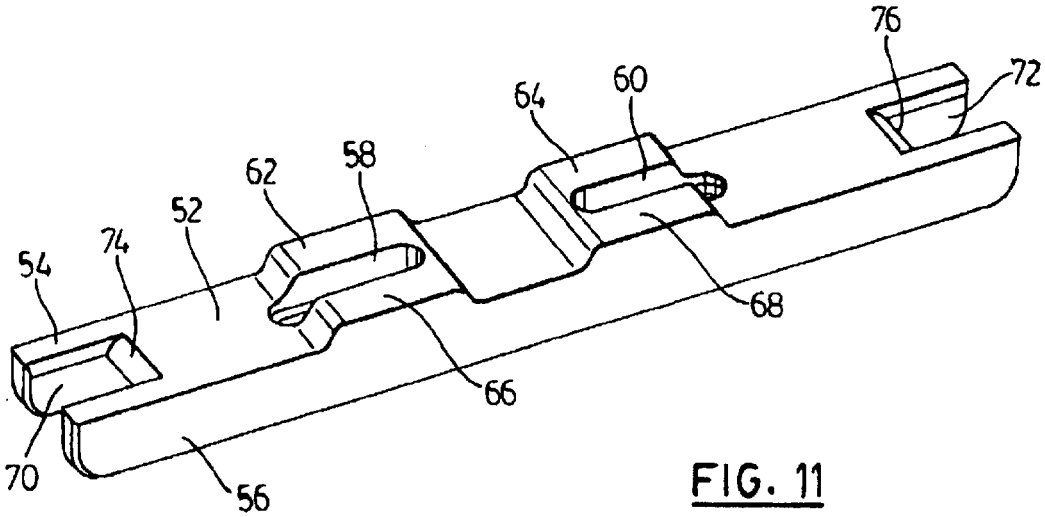
FIG. 11 is a bottom perspective view of the switch interlock apparatus according to the embodiment of FIGS. 6–10.

FIG. 7 is a side elevation, partially in section, of the switch interlock apparatus according to the embodiment of FIG. 6, showing, in further detail, the contours of the slots for receiving the mounting screws. FIG. 8 is an end view, in section, of the switch interlock apparatus according to the embodiment of FIGS. 6–7, taken along line A—A of FIG. 6, showing the general cross-section of the molding at a location between the screw slots. FIG. 9 is an end view, in section, of the switch interlock apparatus according to the embodiment of FIGS. 6–8, taken along line B—B of FIG. 6. FIG. 10 is a top perspective view of the switch interlock apparatus according to the embodiment of FIGS. 6–9, and showing, in particular, an end view of the contours of a screw slot.

Figure 13:
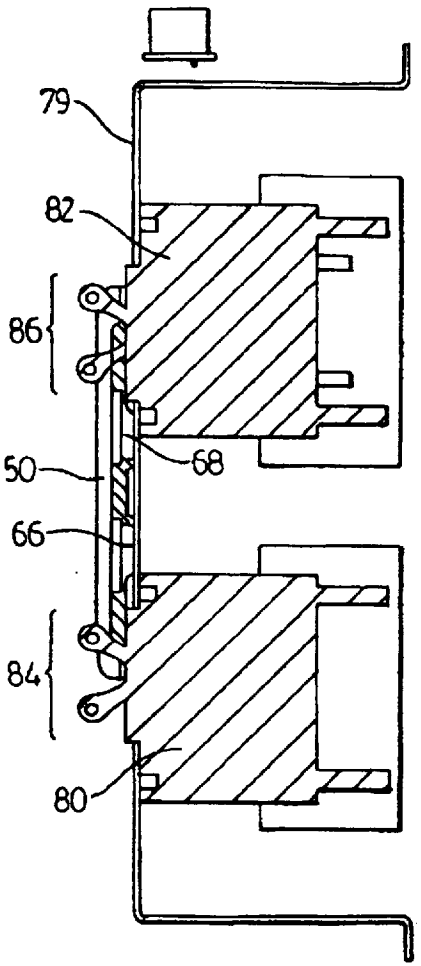
FIG. 13 is a side elevation, partially in section, showing one of the switch interlock apparatus, according to the embodiment of FIGS. 6–12, taken along line A—A of FIG. 12, showing the paired switches in their two respective paired positions.
Figure 12:
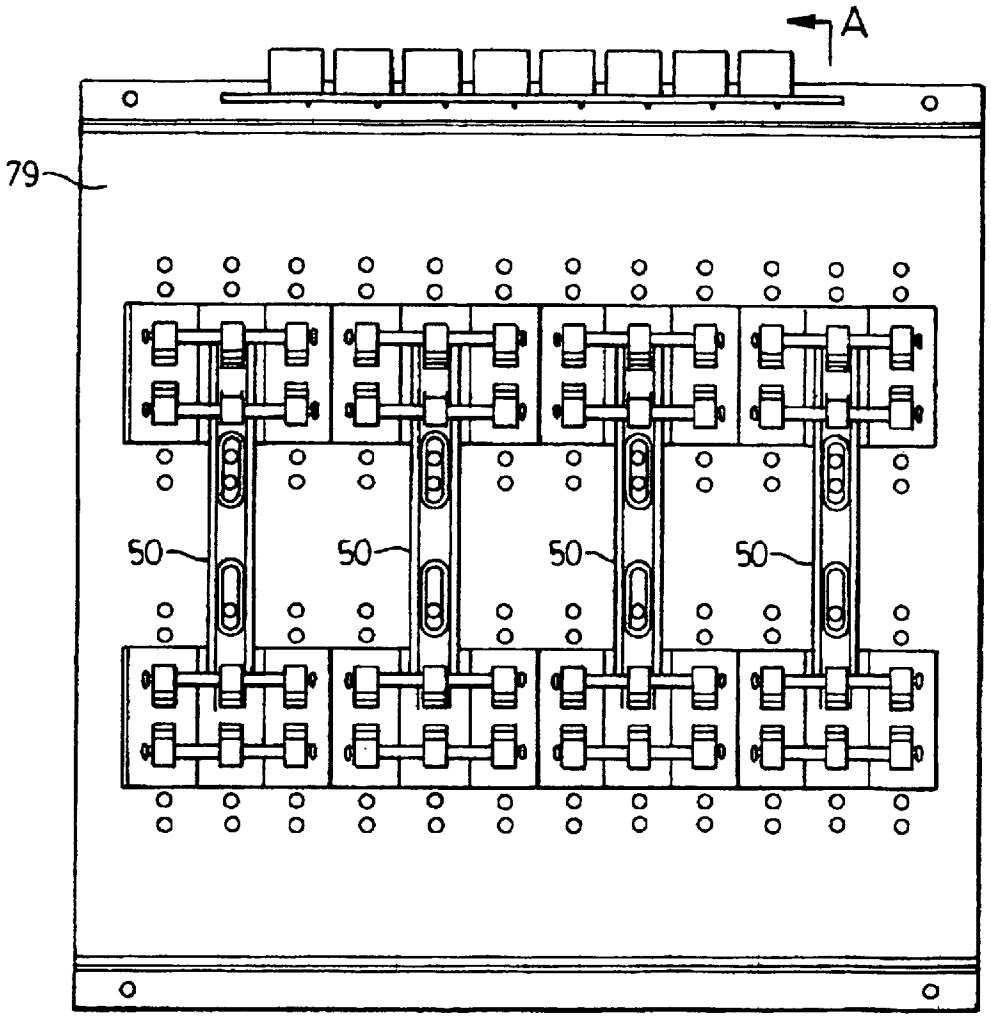
FIG. 12 is a front elevation of a switch panel having four switch interlock apparatus, according to the embodiment of FIGS. 6–11, mounted thereon.
Figure 14:
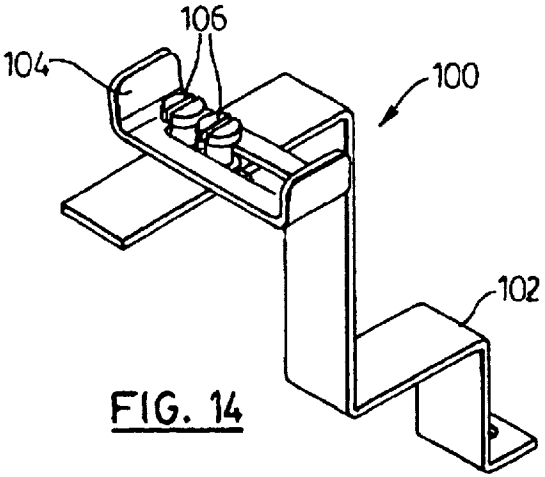
FIG. 14 is a perspective view of a combination interlock apparatus and breaker switch mounting bracket, according to an alternative embodiment of the invention.
Figure 15:
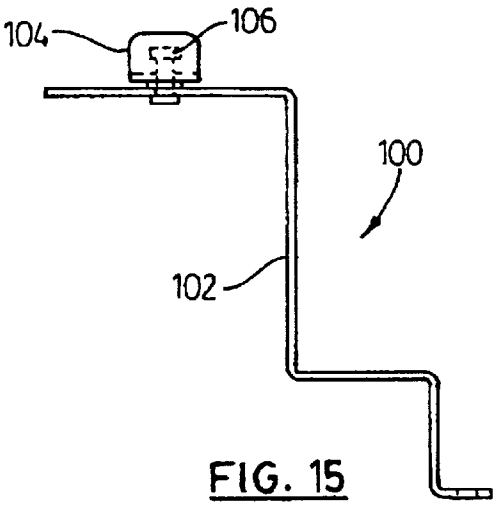
FIG. 15 is a side elevation of the combination interlock apparatus and breaker switch mounting bracket of the embodiment of FIG. 14.
Figure 17:
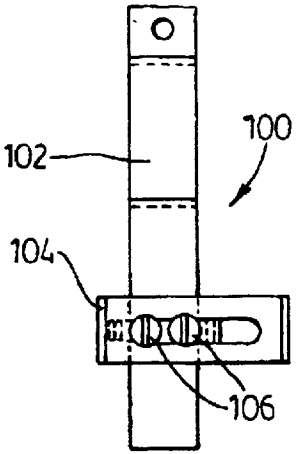
FIG. 17 is a top view of the combination interlock apparatus and breaker switch mounting bracket of the embodiment of FIGS. 14–16.
Figure 16:
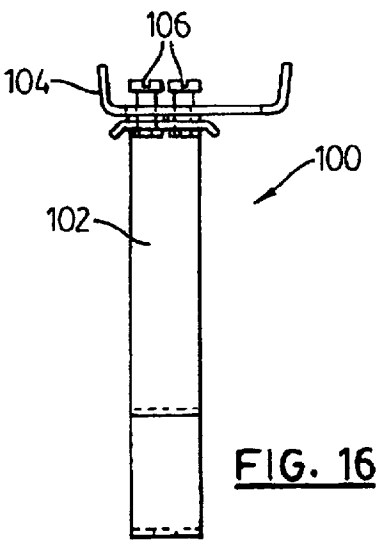
FIG. 16 is an end elevation of the combination interlock apparatus and breaker switch mounting bracket of the embodiment of FIGS. 14–15.
Figure 18:
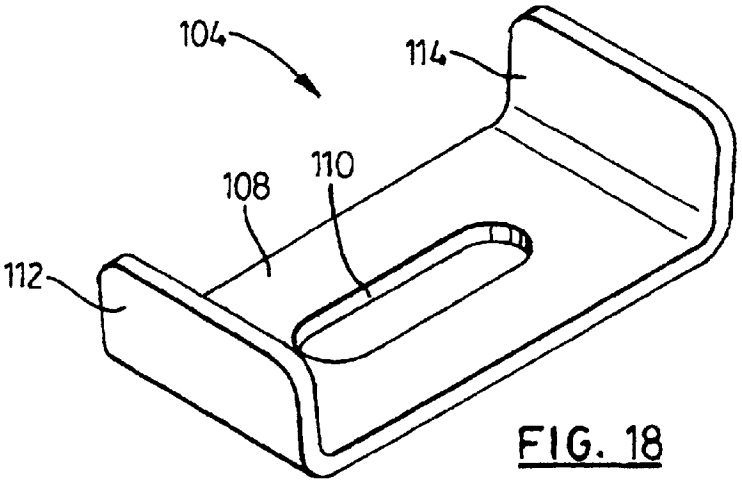
FIG. 18 is a perspective view of the reciprocating interlock member according to the embodiment of FIG. 14.
Figure 21:
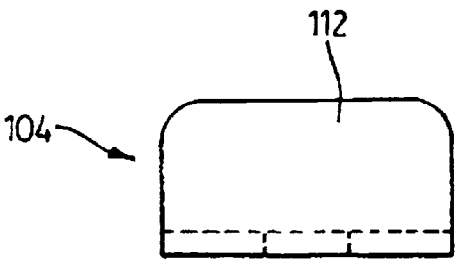
FIG. 21 is an end view of the reciprocating interlock member according to the embodiment of FIG. 14.
Figure 20:
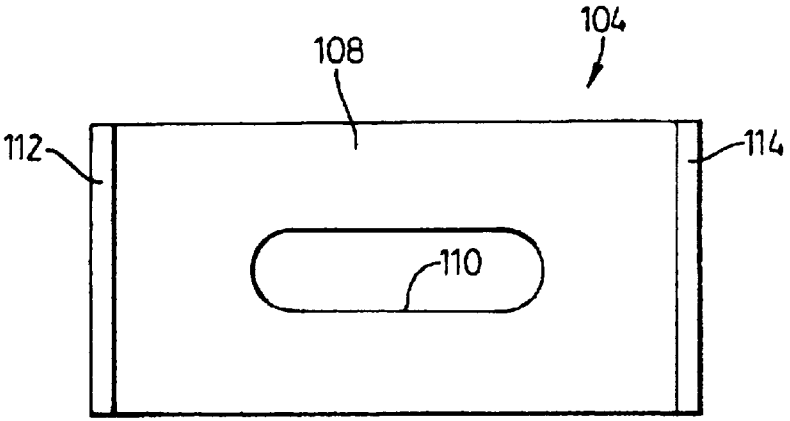
FIG. 20 is a top plan view of the reciprocating interlock member according to the embodiment of FIG. 14.
Figure 19:
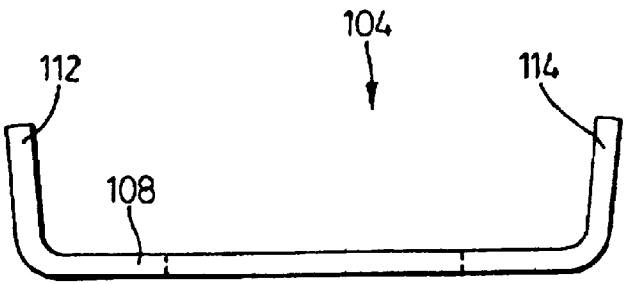
FIG. 19 is a side elevation of the reciprocating interlock member according to the embodiment of FIG. 14.

FIG. 12 is a somewhat schematic front elevation of a switch panel 79 having four switch interlock apparatus 50, according to the embodiment of FIGS. 6–11, mounted thereon. FIG. 13 is a side elevation, partially in section, showing one of the switch interlock apparatus 50, according to the embodiment of FIGS. 6–12, taken along line A—A of FIG. 12, showing paired switches 80, 82, with their respective handles 84, 86 in their two respective paired positions.

The switch interlock apparatus of the present invention have several advantageous design features over the prior art. Each is, in a preferred embodiment of the invention, monolithically formed from a single piece of metal or plastic (although they may be formed from separate parts if desired, without departing from the scope of the invention). Furthermore, each design is capable of being mounted directly to a switch panel, without having to be assembled in situ, apart from the mounting screws. Mounting is simplified through the use of open-ended notches at the ends of the switch apparatus, by simply moving both switch handles of any given pair, to their respective "OFF" positions, and mounting the switch interlock apparatus. The individual switches may be positioned as desired.

The present invention is also useful, in the embodiment of an automatic transfer switch apparatus in that, through the use of powered relays, simplified breaker switches can be employed instead of more complex circuitry. For example, if the control circuitry of the automatic transfer switch detects an oncoming line/utility power failure, the control circuitry powers the relays on the "Generator" side to move toward the "ON" positions. Use of switch interlock apparatus according to the present invention, causes the counterpart line/utility circuit breakers to be tripped to "OFF", before the generator breakers are flipped to "ON". Conversely, if the automatic transfer switch control circuitry detects the restoration of line/utility power, the powered relays on the "Line/Utility" side of the panel will perform the reverse operation, to disengage the generator circuits before restoration of line/utility power to the household circuitry.

A switch interlock apparatus according to an alternative second embodiment is illustrated in FIGS. 14–30A. In this embodiment, switch interlock apparatus 100 includes mounting bracket 102, reciprocating interlock member 104, and one or more fasteners (e.g., nut and bolt combinations) 106 which slidingly hold reciprocating interlock member 104 to mounting bracket 102.

Referring to FIGS. 18–21, reciprocating interlock member 104 includes flat longitudinal central web 108 with elongated slot 110, and two leg webs 112, 114, which are preferably disposed at an oblique (not perpendicular) angle to longitudinal section 108 (although depending upon the particular requirements of a particular installation, they may be). Reciprocating interlock member 104 is preferably fabricated from steel.

Figure 22:
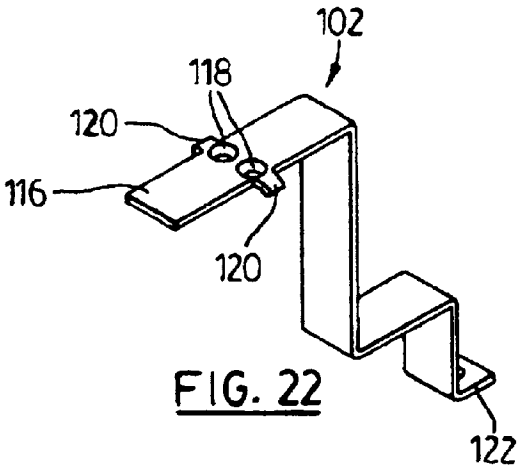
FIG. 22 is a perspective view of the breaker switch mounting bracket according to the embodiment of FIG. 14.
Figure 23:
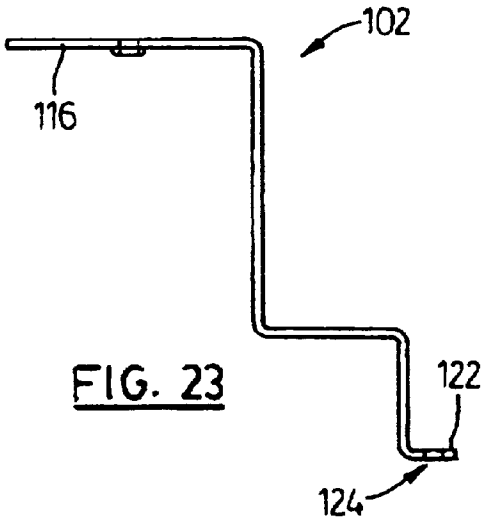
FIG. 23 is a side elevation of the breaker switch mounting bracket according to the embodiment of FIG. 14.
Figure 24:
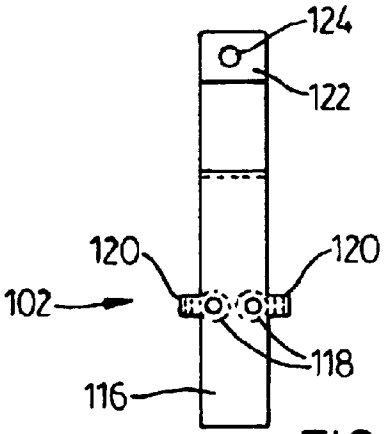
FIG. 24 is a front elevation of the breaker switch mounting bracket according to the embodiment of FIG. 14.
Figure 25:
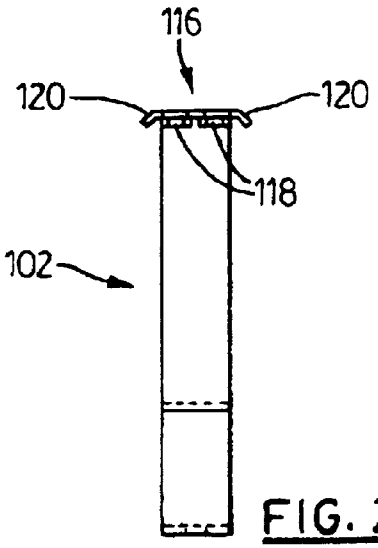
FIG. 25 is a top elevation of the breaker switch mounting bracket according to the embodiment of FIG. 14.
Figure 26:
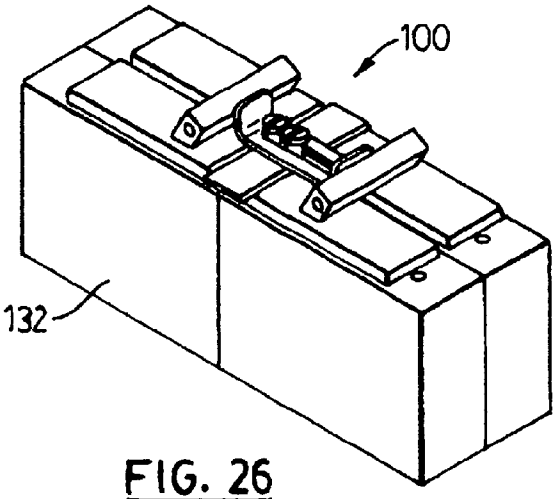
FIG. 26 is a perspective view of a breaker switch block, having a combination interlock apparatus and breaker switch mounting bracket of the embodiment of FIGS. 14–16 positioned thereon.
Figure 27:
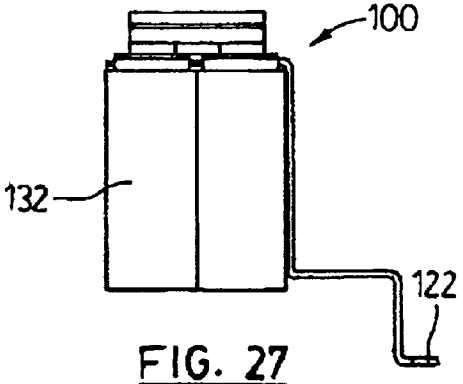
FIG. 27 is an end elevation of the breaker switch block of FIG. 26, having a combination interlock apparatus and breaker switch mounting bracket of the embodiment of FIGS. 14–16 positioned thereon.

Referring to FIGS. 22–24, mounting bracket 102 includes interlock member support leg 116, with fastener aperture(s) 118 and optional stabilizing bars 120; and attachment leg 122, with fastener (e.g., bolt) aperture 124. The length, shape, and orientation of the portions of mounting bracket 102, between interlock member support leg 116 and attachment leg 122 may be in the "S" shape as illustrated, or may be in such other suitable configurations as necessary to achieve placement of the reciprocating switch interlock member 104 in the appropriate position between the switch handles, while being attached at the attachment leg, to the housing base for the devices (e.g., breaker switches) in which the devices are mounted, such that the interlock member support leg 116 simultaneously holds the subject devices (e.g., breaker switches) in place in the housing base. Stabilizing bars 120, which may or may not be provided, depending upon the configurations of the faces of the devices (breaker switches) and available space constraints, can help give interlock member support leg 116 a greater "footprint" against the faces of the devices, for enhanced stability and exertion of force against the faces of the devices. FIGS. 14–17 illustrate reciprocating member 104 affixed to mounting bracket 102.

Figure 30:
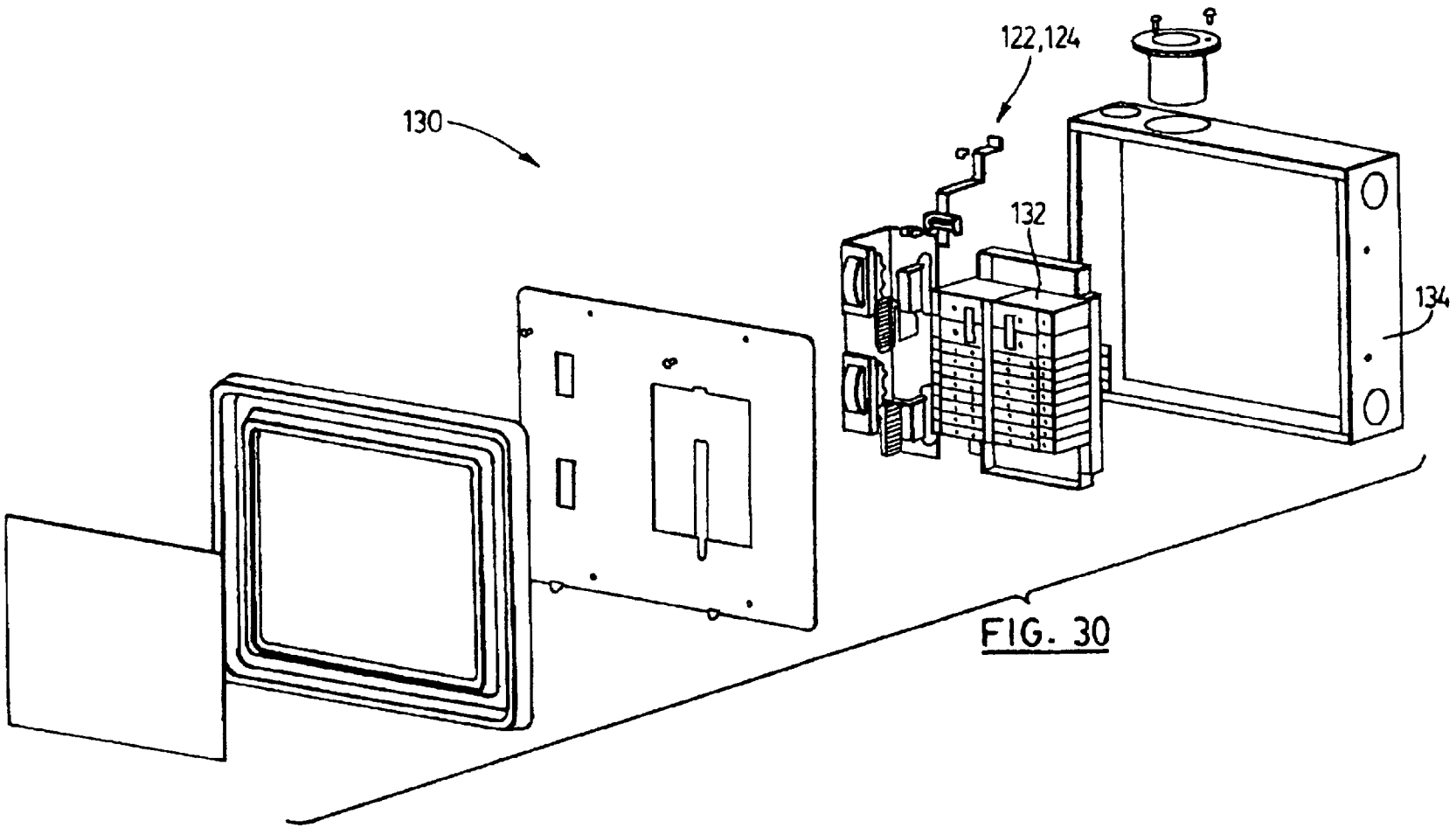
FIG. 30 is an exploded perspective view of a transfer switch apparatus, incorporating the combination interlock apparatus and breaker switch mounting bracket of embodiment of FIG. 14.
Figure 30A:
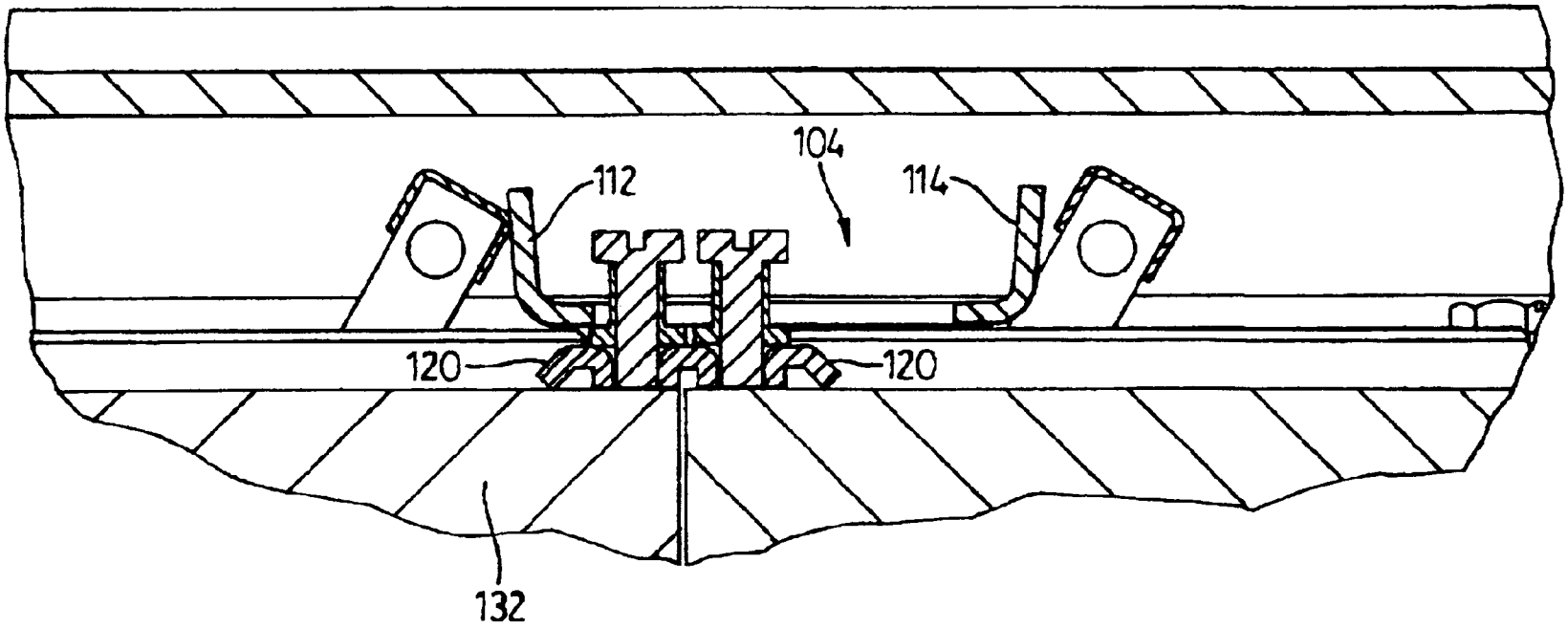
FIG. 30A is an enlarged, fragmentary view of a breaker switch block, having a combination interlock apparatus and breaker switch mounting bracket of the embodiment of FIGS. 14–16 positioned thereon.

FIG. 30 illustrates an exploded view of an apparatus (e.g., a transfer switch) 130, incorporating a breaker switch block 132 which is, in part, held in place by switch interlock apparatus 100, which is attached to housing base 134, via a bolt through aperture 124 in attachment leg 122. When in place, reciprocating interlock member 104 will be positioned between the handles of the switches in the breaker switch block 132, to operate in accordance with the same principles as the previously described embodiment, to affect a "break before make" flipping of the switches. FIG. 30A shows the positioning of reciprocating member 104 in an enlarged view.

A third embodiment of the invention is illustrated in FIGS. 31–42. Switch interlock apparatus 200 includes mounting frame 202, reciprocating interlock member 204, a mounting post in the form of a bolt 206*a*. Reciprocating interlock member 204 includes longitudinal flat central web 210 with longitudinal slot 212, and leg webs 214, 216. Mounting frame 202 (FIGS. 37–42) includes longitudinal legs 220, 222, with side flanges 224, 226, and inwardly angled spring clip members 228; transverse webs 230, 232; and central transverse web 234 with guide members 236, 238, 240, 242. Mounting post or bolt 206*a* may be permanently affixed to frame 202, or simply screwed in place, e.g., via aperture 231.

In operation, reciprocating interlock member 204 is placed atop frame 202, with mounting post or bolt 206*a* passing through slot 212. Nut 206*b* is screwed down onto mounting post or bolt 206*a*, sufficiently tight to prevent undesired wobbling against the top of frame 202, but not so tightly that reciprocating interlock member 204 cannot readily slide relative to mounting frame 202.

Figure 28:
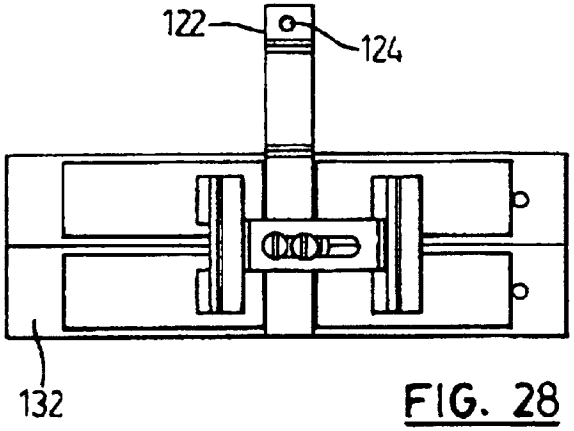
FIG. 28 is a top view of the breaker switch block of FIG. 26, having a combination interlock apparatus and breaker switch mounting bracket of the embodiment of FIGS. 14–16 positioned thereon.
Figure 29:
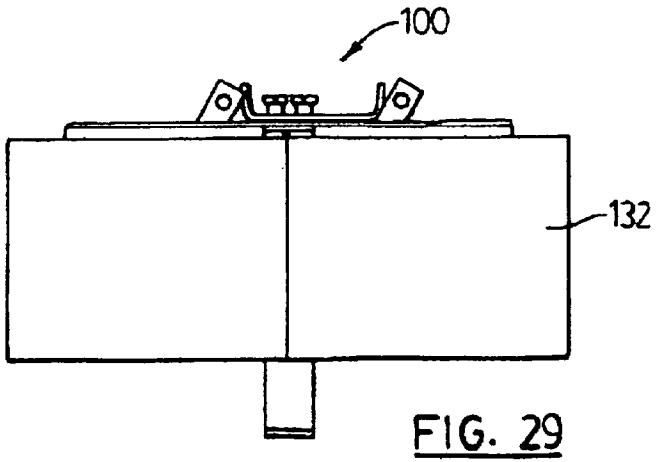
FIG. 29 is a side elevation of the breaker switch block of FIG. 26, having a combination interlock apparatus and breaker switch mounting bracket of the embodiment of FIGS. 14–16 positioned thereon.
Figure 31:
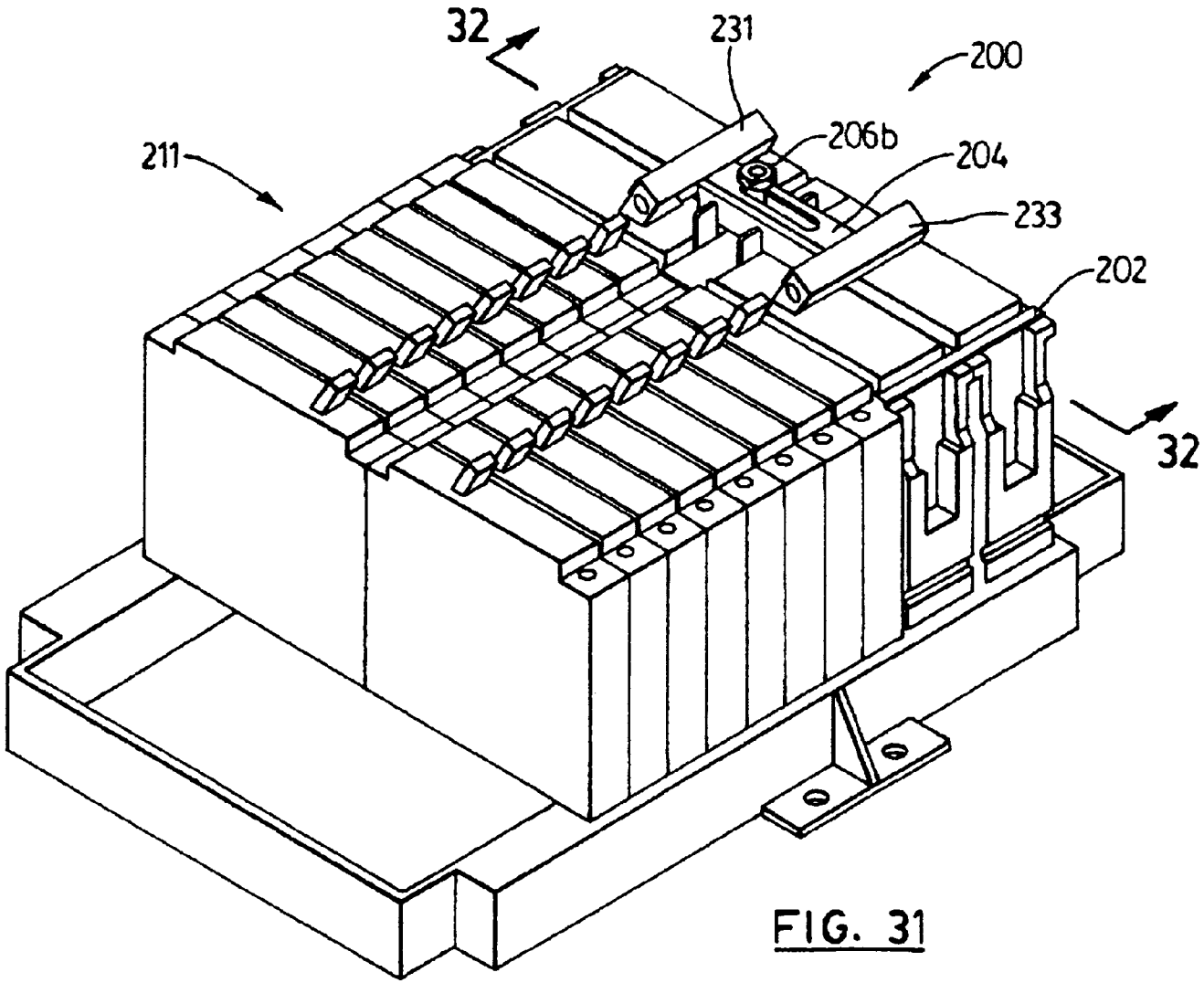
FIG. 31 is a perspective view of a representative breaker switch block, showing a switch interlock apparatus according to yet another alternative embodiment of the invention.

In addition, typical breaker switch blocks all have an undercut ledge around the periphery of the block adjacent the front face. Mounting of the assembled switch interlock apparatus is accomplished by moving both switch handles 231, 233 to their respective "OFF" positions, and then pushing mounting frame 202 onto the faces of the breaker switch block. As the pushing is continued, inwardly angled spring clip members 228 will be pushed inwardly to be flush with flanges 224, 226, until after the ledges (edges of the front faces of the breaker switches) are passed, permitting inwardly angled spring clip members 228 are permitted to move back to their "at rest" positions, as shown in FIGS. 28, 30 and 31. Thus, mounting frame 202 is securely and effectively permanently affixed in place on breaker switch block 230. To remove mounting frame 202, would require permanent destructive deformation of it, as it is manufactured preferably from steel. Accordingly, attachment of switch interlock apparatus 200 to breaker switch block 230 requires no fasteners and no tools, is rapidly accomplished, but results in a secure, essentially permanent attachment.

Figure 32:
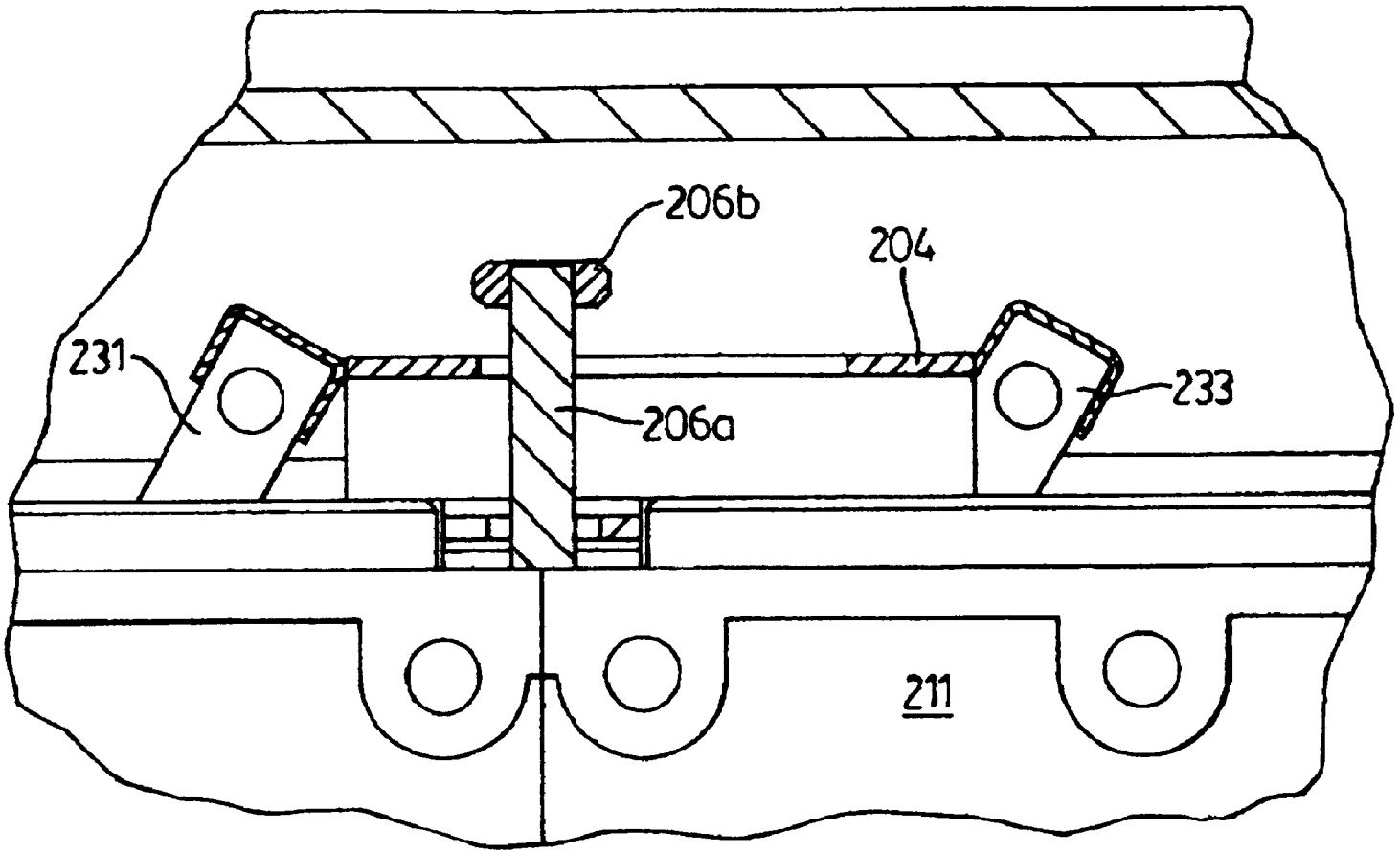
FIG. 32 is a side elevation, in section, of the switch interlock apparatus, taken along line 32—32 of FIG. 31.
Figure 32A:
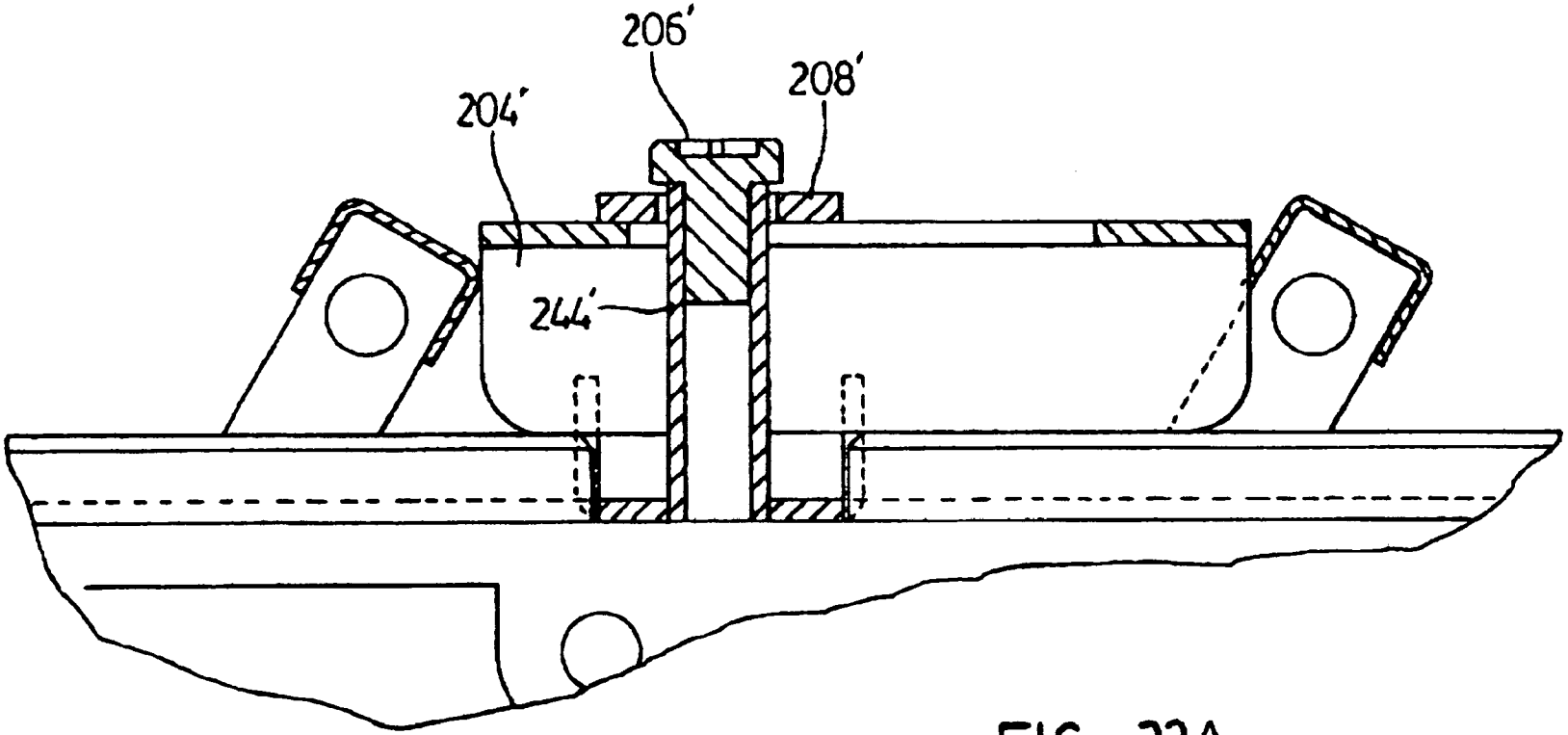
FIG. 32A is an enlarged side elevation of a modification of the switch interlock apparatus of FIGS. 31–32.
Figure 33:
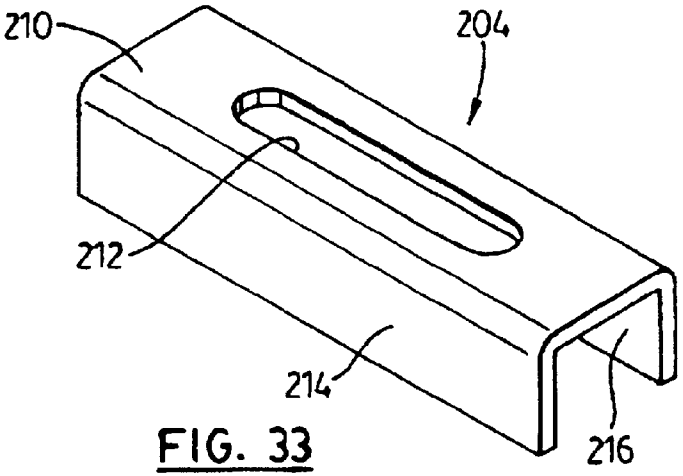
FIG. 33 is a perspective view of the reciprocating interlock member, according to the embodiment of FIG. 31.
Figure 36:
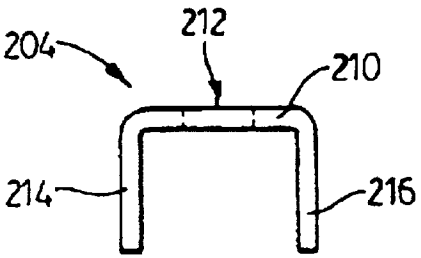
FIG. 36 is an end elevation of the reciprocating interlock member according to the embodiment of FIG. 31.
Figure 34:
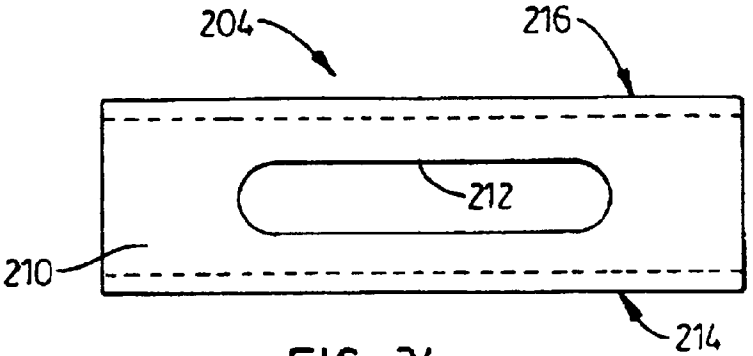
FIG. 34 is a top plan view of the reciprocating interlock member according to the embodiment of FIG. 31.
Figure 35:
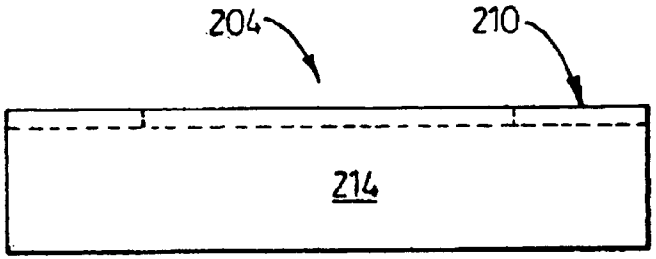
FIG. 35 is a side elevation of the reciprocating interlock member according to the embodiment of FIG. 31.
Figure 37:
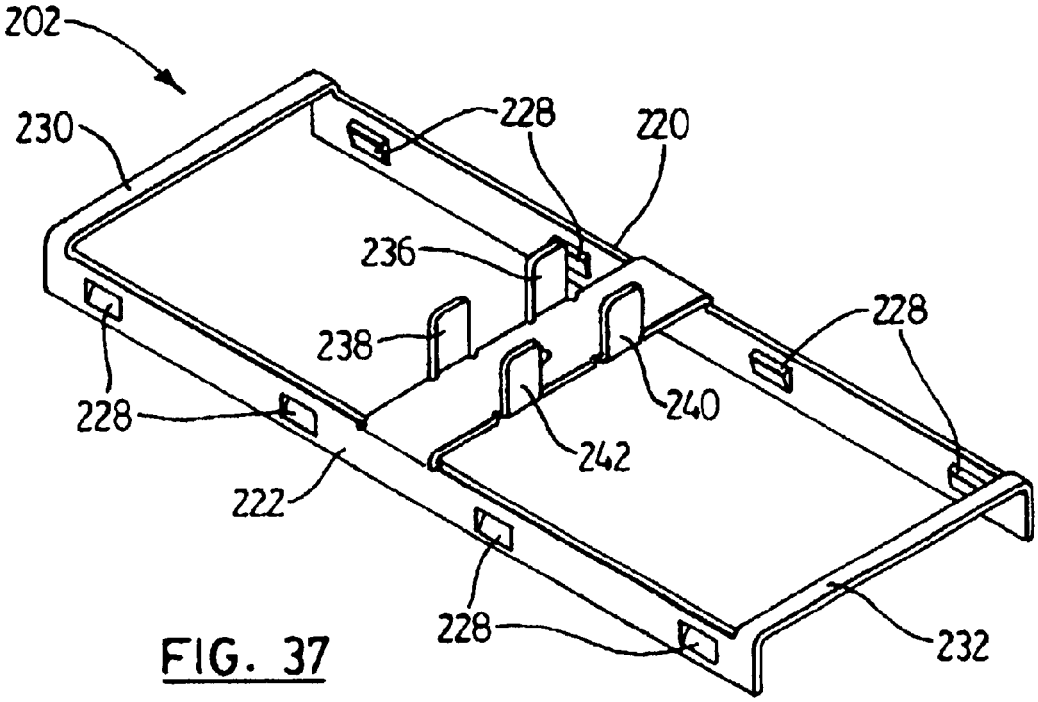
FIG. 37 is a perspective view of a mounting frame, for use in mounting the reciprocating interlock member of the embodiment of FIG. 31.
Figure 41:
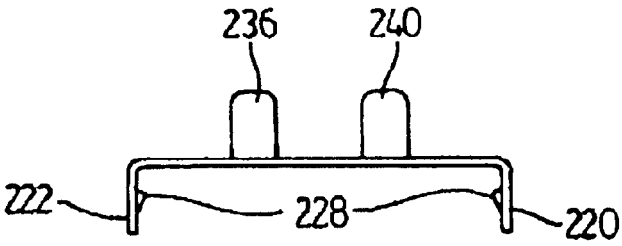
FIG. 41 is an end elevation of the mounting frame of FIG. 31.
Figure 42:
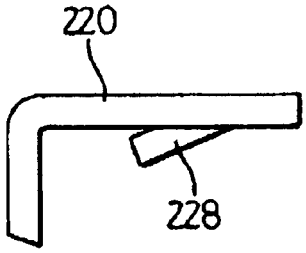
FIG. 42 is an enlarged fragmentary view of a portion of the mounting frame of FIG. 31.
Figure 38:
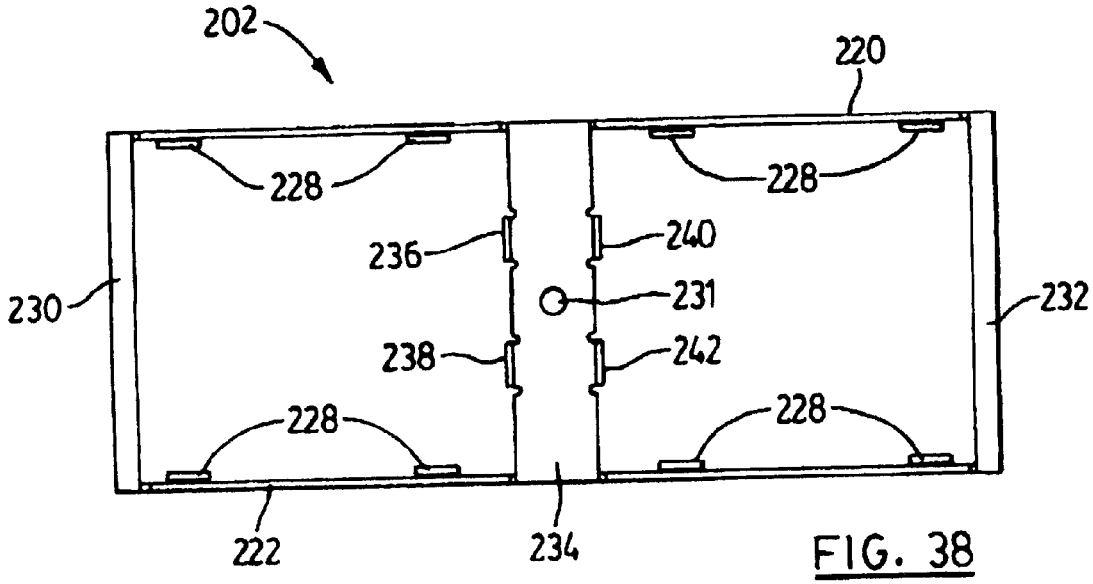
FIG. 38 is a top plan view of the mounting frame, of FIG. 31.
Figure 39:
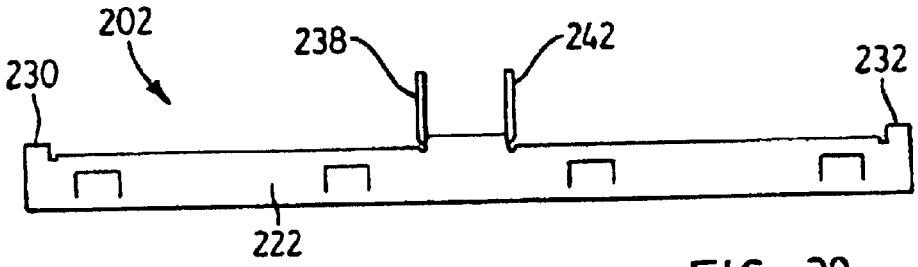
FIG. 39 is a side elevation of the mounting frame of FIG. 31.
Figure 40:
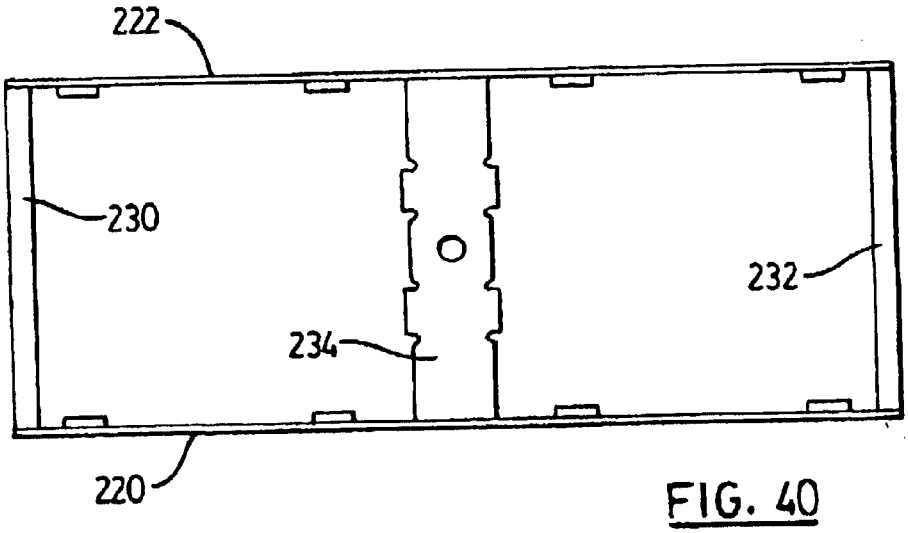
FIG. 40 is a bottom view of the mounting frame of FIG. 31.
Figure 43:
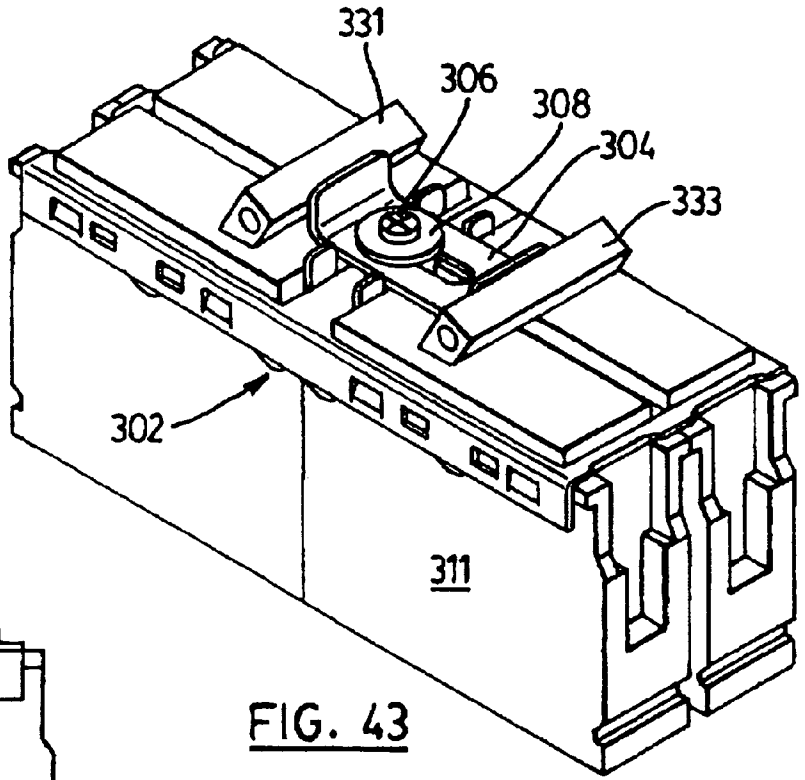
FIG. 43 is a perspective view of a switch interlock apparatus according to another alternative embodiment of the invention, shown in position on a breaker switch block.
Figure 44:
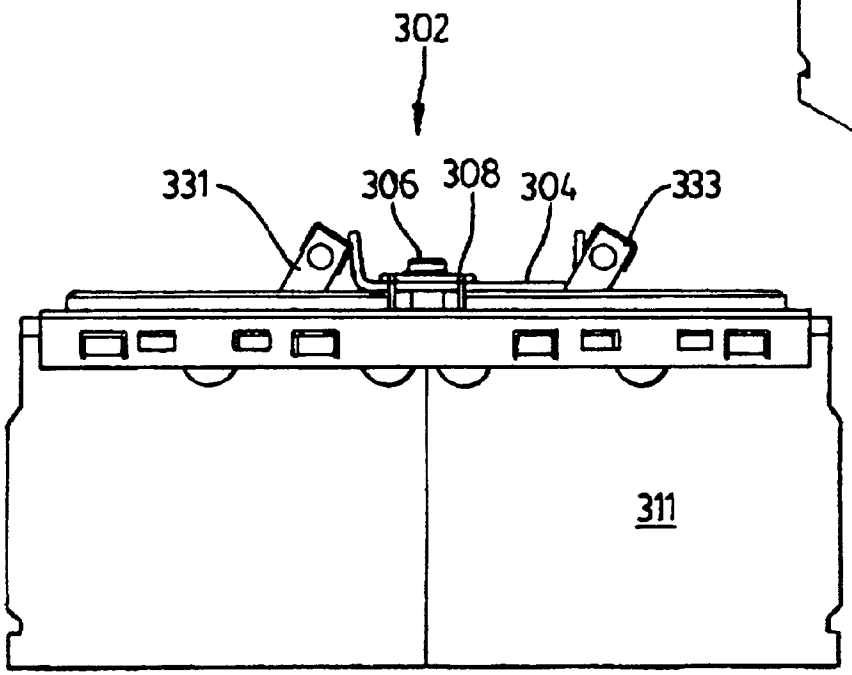
FIG. 44 is a side elevation of the breaker switch block of FIG. 43.
Figure 45:
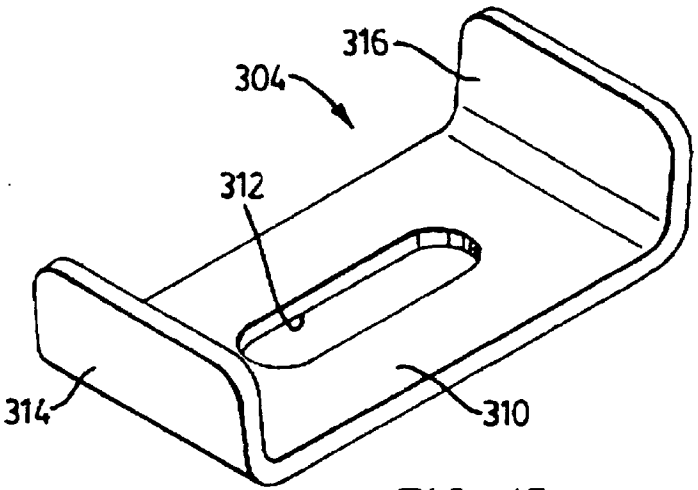
FIG. 45 is a perspective view from above, of the reciprocating interlock member of the switch interlock apparatus of the embodiment of FIG. 43.
Figure 48:
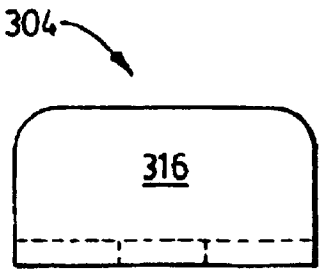
FIG. 48 is an end view of the reciprocating interlock member of FIG. 45.
Figure 46:
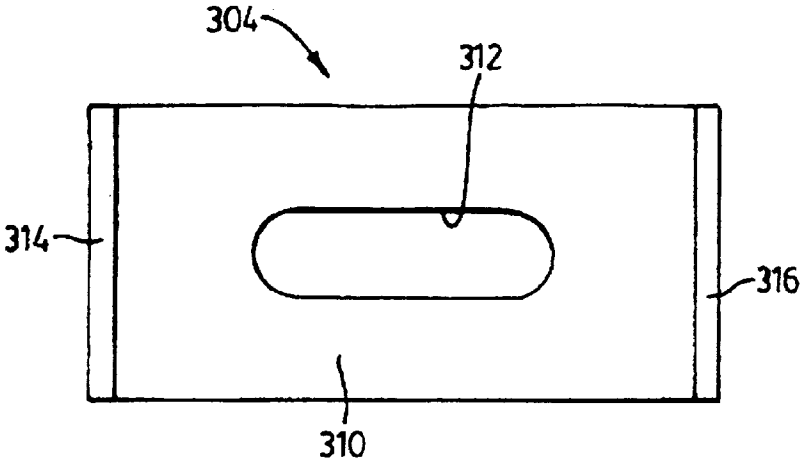
FIG. 46 is a top view of the reciprocating interlock member of FIG. 45.
Figure 47:
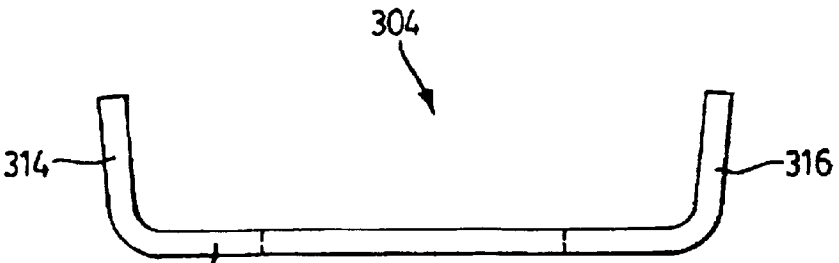
FIG. 47 is a side elevation of the reciprocating interlock member of FIG. 45.
Figure 49:
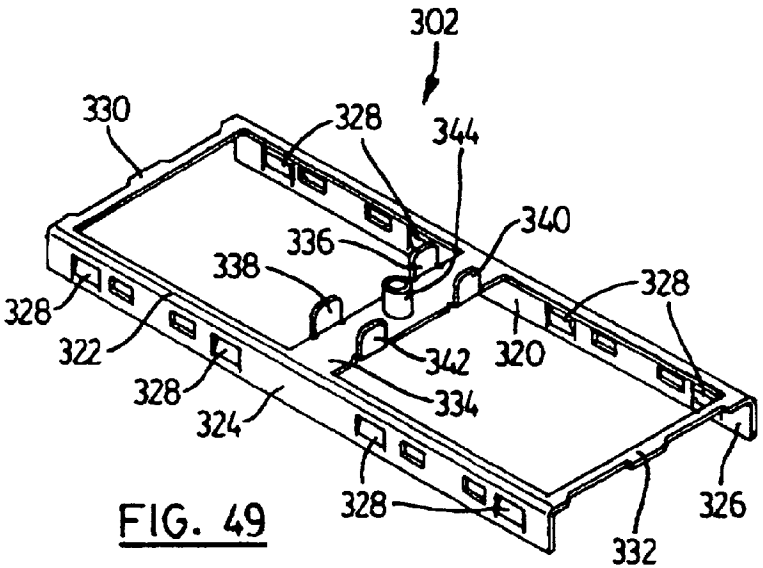
FIG. 49 is a perspective view of a frame for use with the reciprocating interlock member of FIG. 45.
Figure 52:
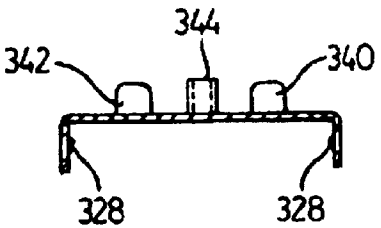
FIG. 52 is an end elevation of the frame of FIG. 49.
Figure 50:
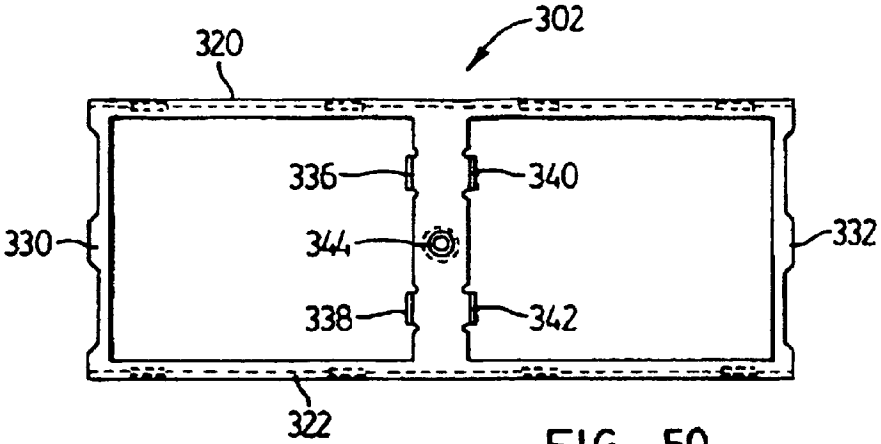
FIG. 50 is a top view of the frame of FIG. 49.
Figure 51:
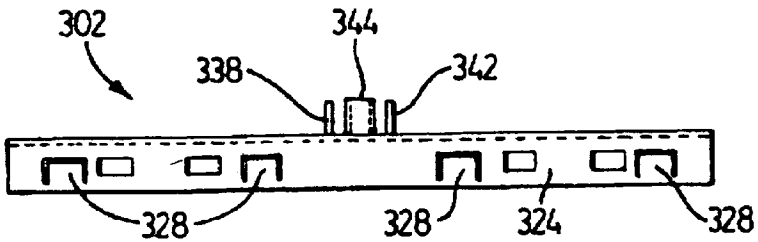
FIG. 51 is a side elevation of the frame of FIG. 49.
Figure 53:
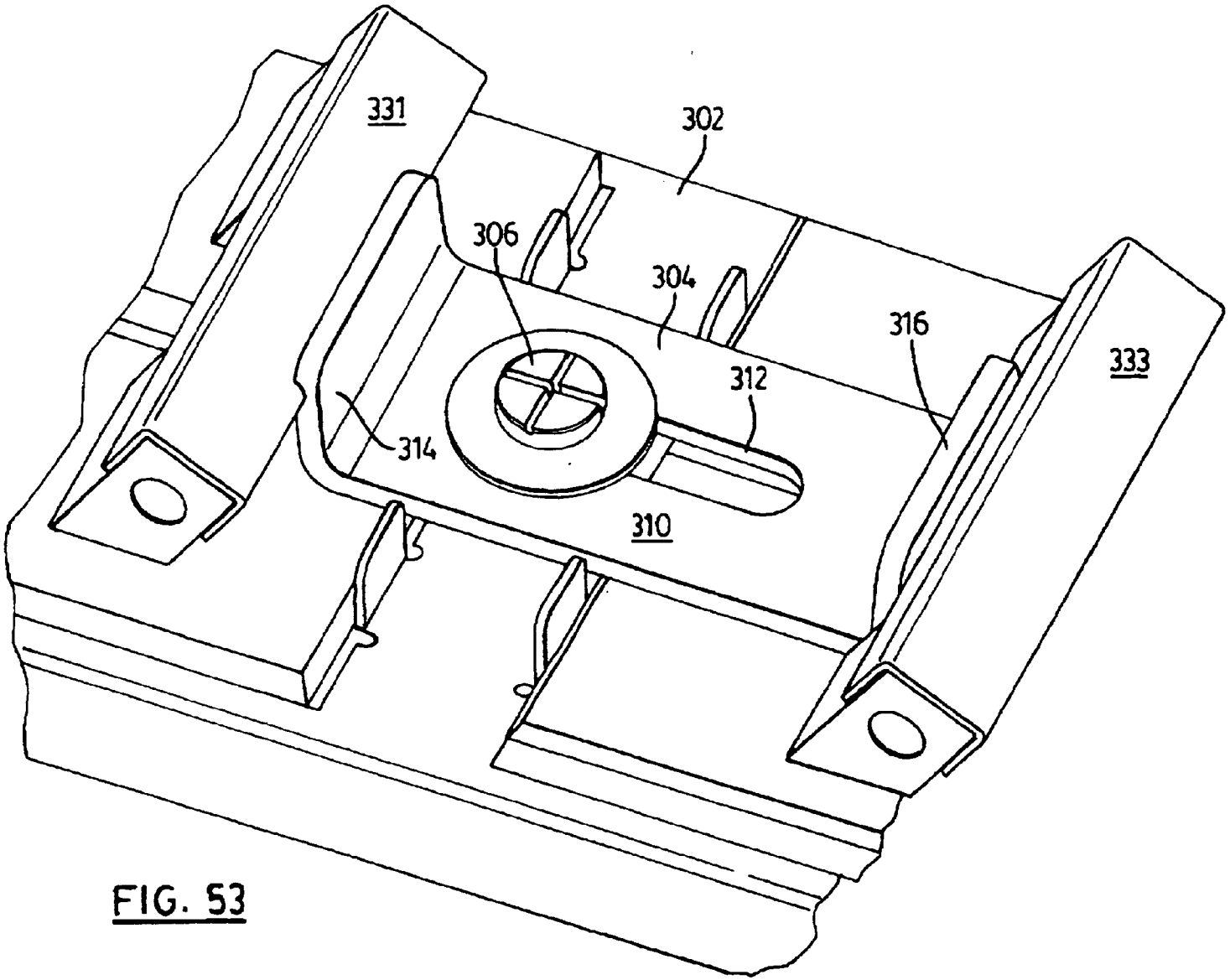
FIG. 53 is a fragmentary top perspective view of the switch interlock apparatus formed by the reciprocating interlock member of FIG. 45 and frame of FIG. 49, in position on a breaker switch block.
Figure 54:
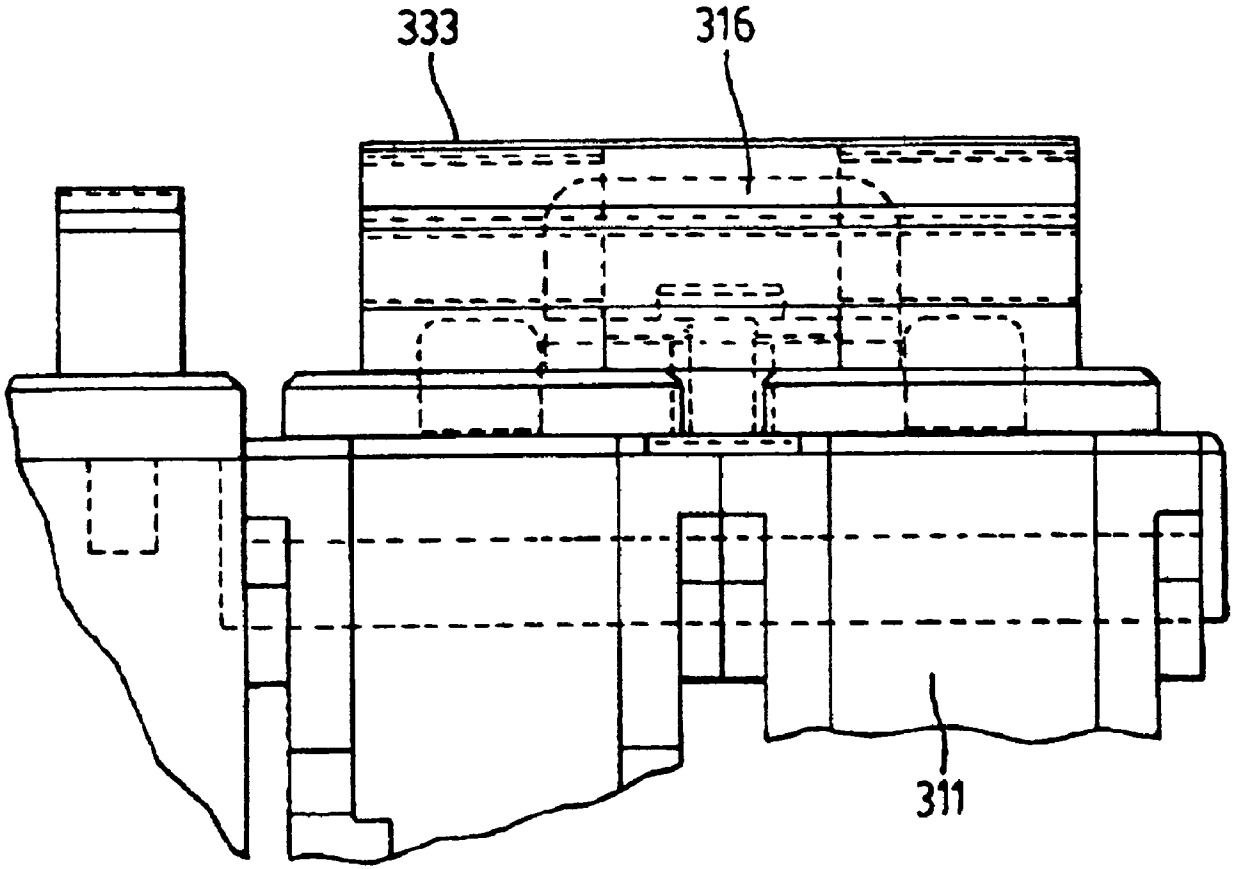
FIG. 54 is a fragmentary end view of the switch interlock apparatus formed by the reciprocating interlock member of FIG. 45 and frame of FIG. 49, in position on a breaker switch block.

In a variation of the embodiment of FIG. 31, shown in FIG. 32A, the frame is provided with hollow or blind bored mounting post 244', which is preferably internally threaded to match a suitably selected fastener (bolt) 206'. A washer 208' is preferably used atop reciprocating member 204. This alternative frame construction is illustrated in the embodiment of FIGS. 49–54.

A fourth embodiment of the invention is illustrated in FIGS. 43–54. Switch interlock apparatus 300, mounted on breaker switch block 338, includes mounting frame 302, reciprocating interlock member 304, fastener (e.g., bolt) 306 and, preferably, washer 308. Reciprocating interlock member 304, as shown in FIGS. 45–48, includes longitudinal flat central web 310 with longitudinal slot 312, and leg webs 314, 316. Mounting frame 302 is illustrated in FIGS. 49–52, and includes longitudinal legs 320, 322, with side flanges 324, 326, and inwardly angled spring clip members 328; transverse webs 330, 332; and central transverse web 334 with guide members 336, 338, 340, 342, and mounting post 344, which is preferably internally threaded to match a suitably selected fastener (bolt) 306.

In operation, reciprocating interlock member 304 is placed atop mounting post 344, a suitable washer 308 (if desired) is placed atop reciprocating interlock member 304, and fastener 306 is screwed down, sufficiently tight to prevent undesired wobbling against the top of mounting post 344, but not so tightly that reciprocating interlock member 304 cannot readily slide relative to mounting frame 302. Preferably, the distance between the bottom of longitudinal flat portion 310 and the bottom edges of legs 314, 316 is slightly less than the height of mounting post 344.

In addition, typical breaker switch blocks all have an undercut ledge around the periphery of the block adjacent the front face. Mounting of the assembled switch interlock apparatus is accomplished by moving both switch handles 331, 333 to their respective "OFF" positions, and then pushing mounting frame 302 onto the faces of the breaker switch block. As the pushing is continued, inwardly angled spring clip members 328 will be pushed inwardly to be flush with flanges 324, 326, until after the ledges (edges of the front faces of the breaker switches) are passed, permitting inwardly angled spring clip members 328 are permitted to move back to their "at rest". Thus, mounting frame 302 is securely and effectively permanently affixed in place on breaker switch block 338. To remove mounting frame 302, would require permanent destructive deformation of it, as it is manufactured preferably from steel. Accordingly, attachment of switch interlock apparatus 300 to breaker switch block 330 requires no fasteners and no tools, is rapidly accomplished, but results in a secure, essentially permanent attachment.

Figure 55:
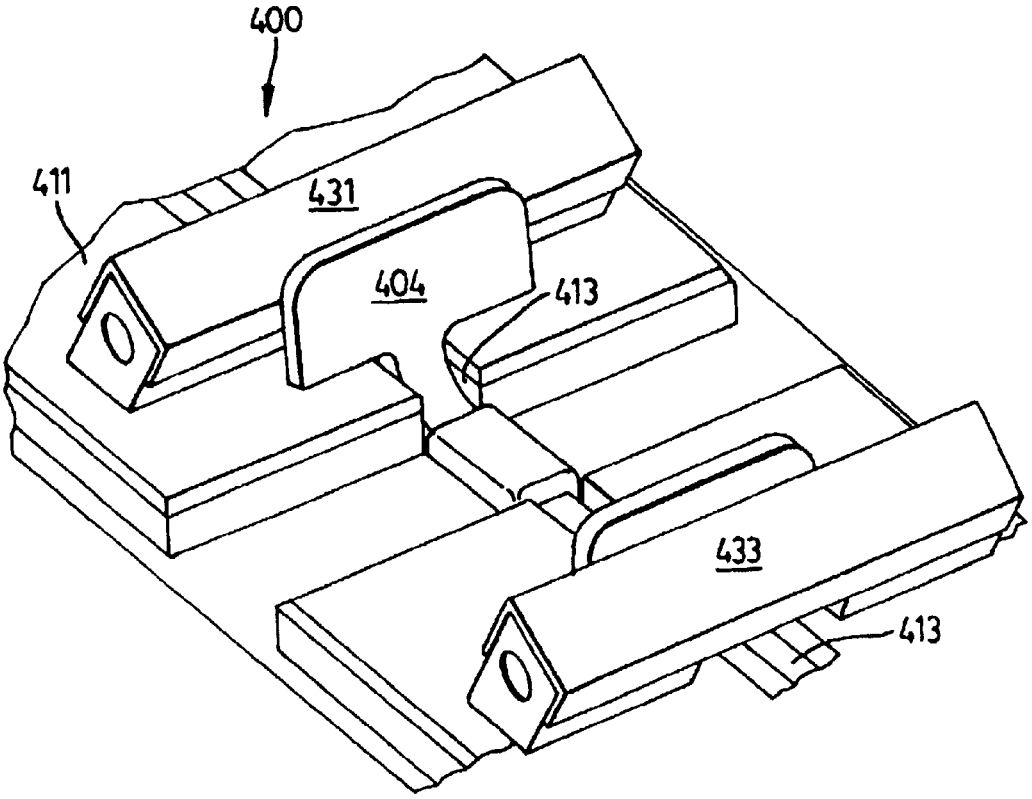
FIG. 55 is a fragmentary perspective view of a breaker switch block, having a switch interlock apparatus, according to another alternative embodiment of the invention, positioned thereon.
Figure 56:
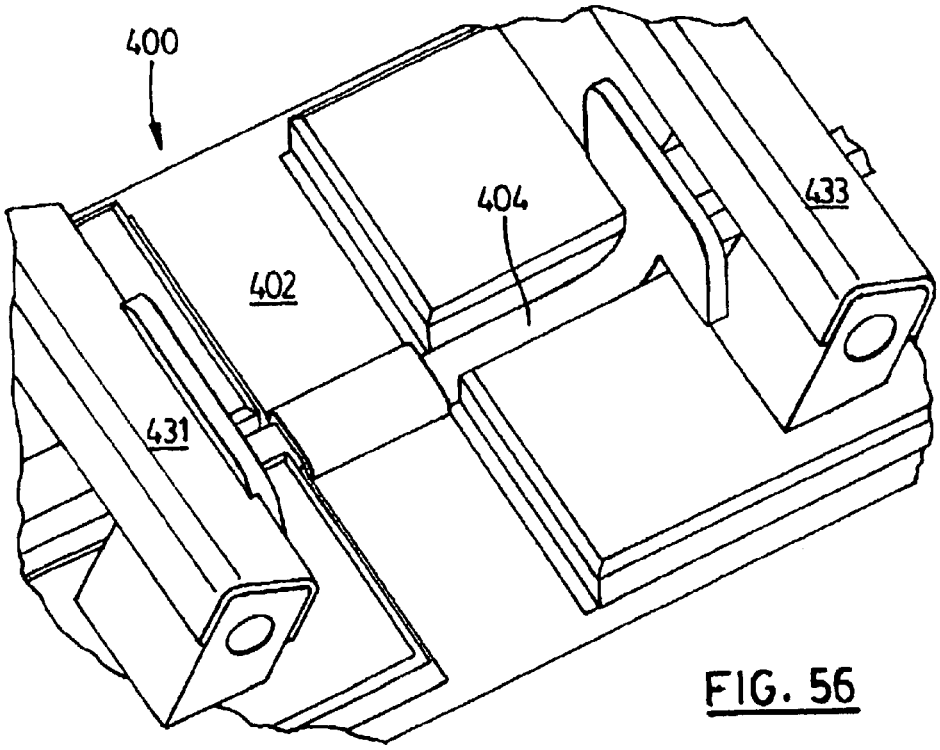
FIG. 56 is another fragmentary perspective view of a breaker switch block, having the switch interlock apparatus, according to the alternative embodiment of FIG. 55, positioned thereon.
Figure 57:
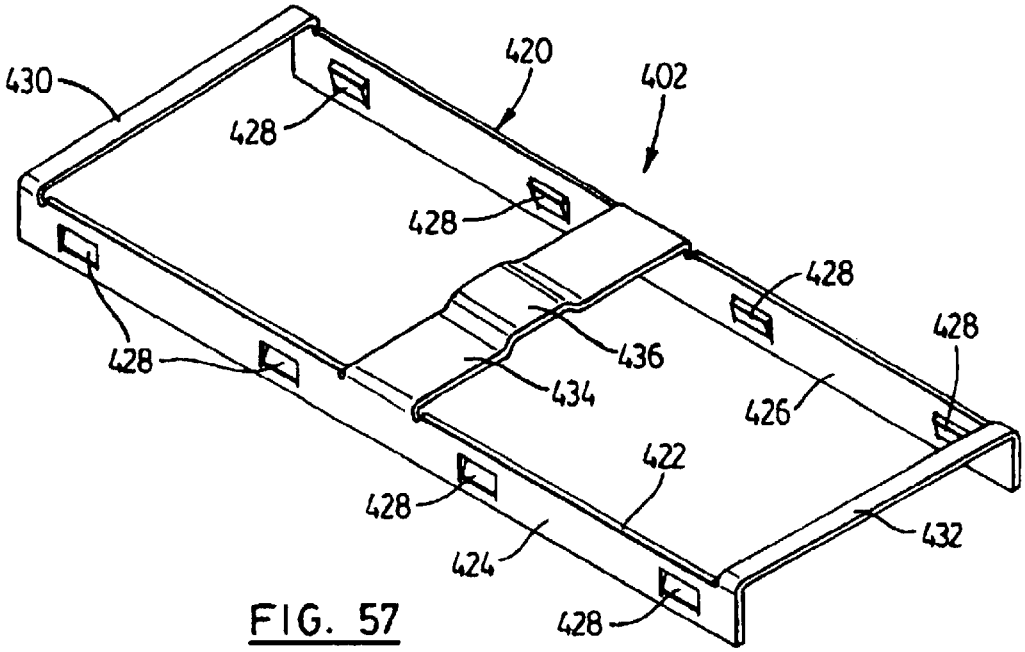
FIG. 57 is a perspective view of a frame for use with the reciprocating interlock member of FIGS. 55 and 56.
Figure 58:
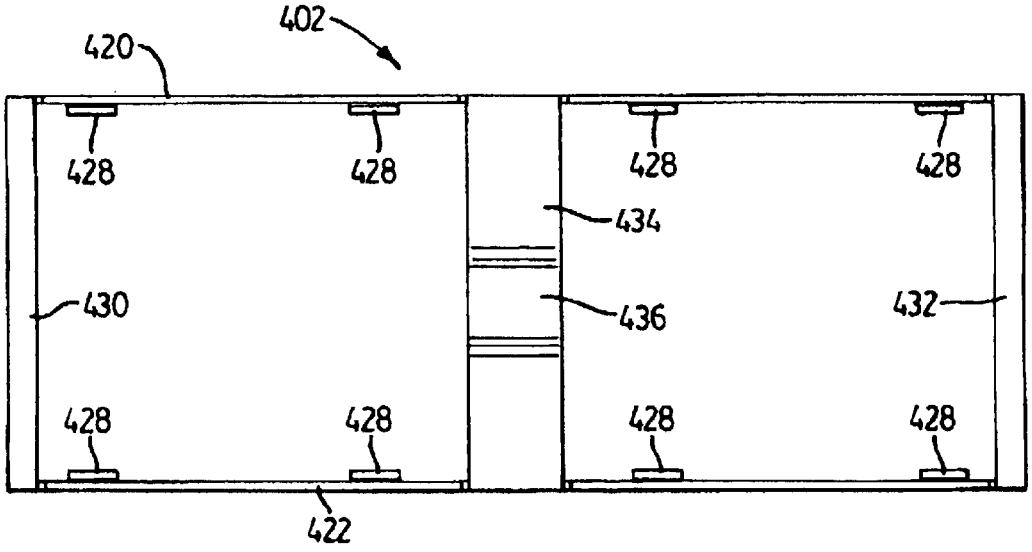
FIG. 58 is a top view of the frame of FIG. 57.
Figure 59:
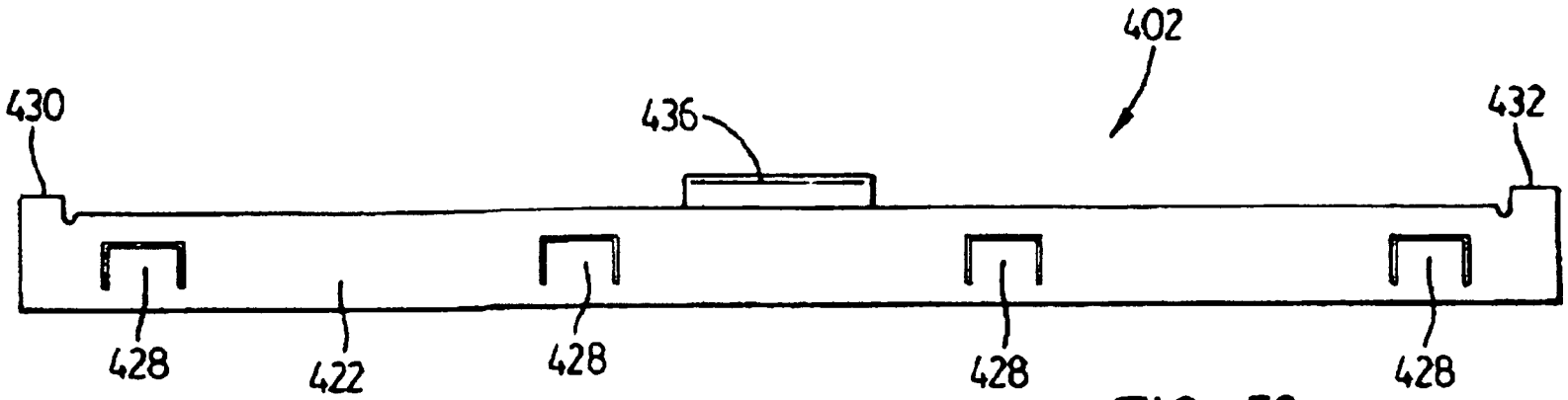
FIG. 59 is a side elevation of the frame of FIG. 57.
Figure 60:
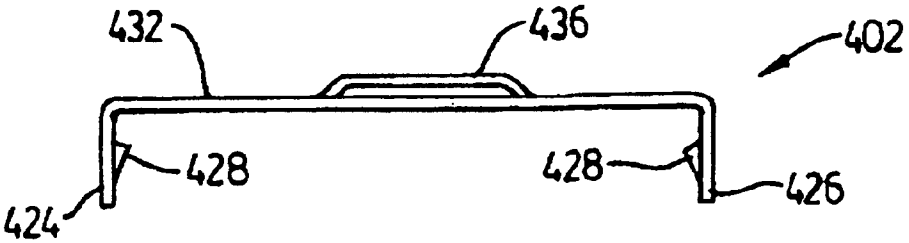
FIG. 60 is an end elevation of the frame of FIG. 57.
Figure 61:
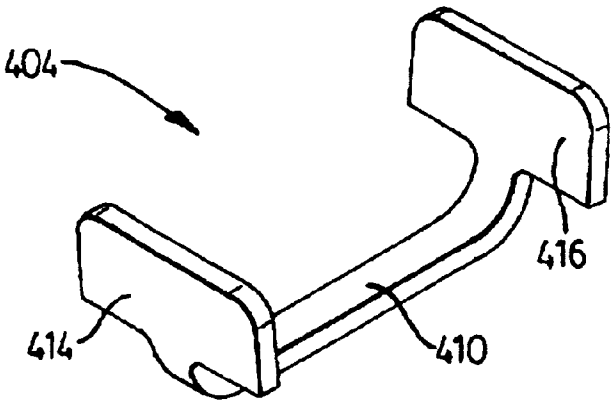
FIG. 61 is a perspective view of a reciprocating interlock member for use with the frame of FIG. 57.
Figure 64:
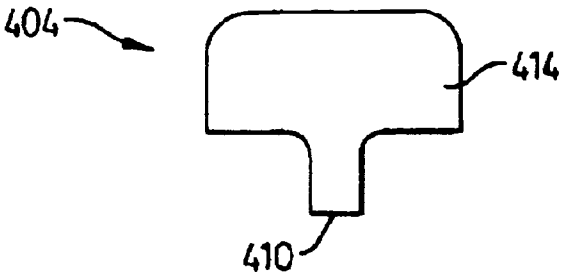
FIG. 64 is an end elevation of the reciprocating interlock member of FIG. 61.
Figure 62:
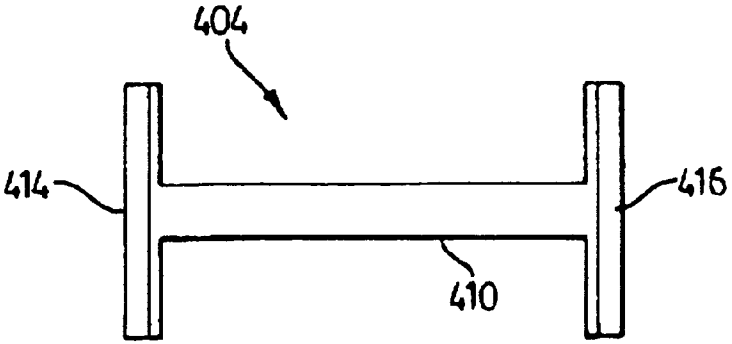
FIG. 62 is a top view of the reciprocating interlock member of FIG. 61.
Figure 63:
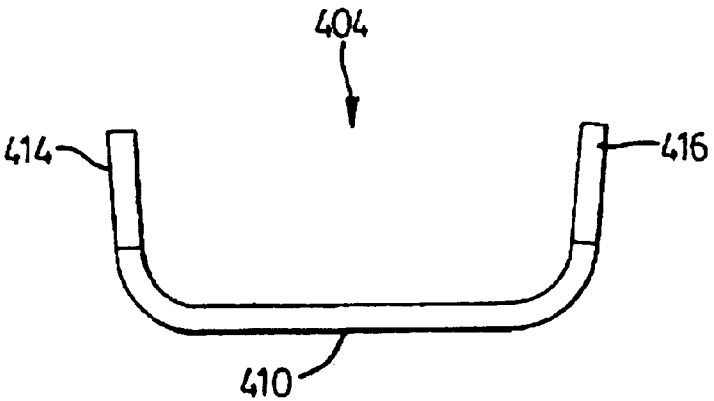
FIG. 63 is a side elevation of the reciprocating interlock member of FIG. 61.

In a fifth embodiment, shown in FIGS. 55–64, switch interlock apparatus 400 includes mounting frame 402 and reciprocating interlock member 404 (between switch handles 431, 433), shown mounted on breaker switch block 411 in FIGS. 55–56. Mounting frame 402 is illustrated in FIGS. 57–60, and includes longitudinal legs 420, 422, with side flanges 424, 426, and inwardly angled spring clip members 428; transverse webs 430, 432; and central transverse web 434 with guide channel 436. Reciprocating interlock member 404 includes narrow longitudinal central web 410 with leg webs 414, 416. In typical breaker switch block constructions, particularly those with switch handles that have two stems each, there is a longitudinally running groove 413. Preferably, narrow longitudinal central web 410 has a width which is slightly less than the width of groove 413.

Installation of switch interlock apparatus 400 is accomplished by first placing reciprocating interlock member 404, particularly narrow central web 410, into groove 413. Then, mounting frame 404 is aligned with the face of breaker switch block 411, and snapped into place, in a manner similar to that described with respect to the previous two embodiments, again resulting in a simplified, tool-less yet essentially permanent installation.

In the event that no groove 413 is provided in breaker switch block 411, mounting frame 402 will be appropriately dimensioned so that the non-raised portions of central web 434 will be flush with the face surface of breaker switch block 411, while the height, width and length of channel 436 will be sufficient to enclose without binding narrow central web 410, while limiting wobble.

Figure 66:
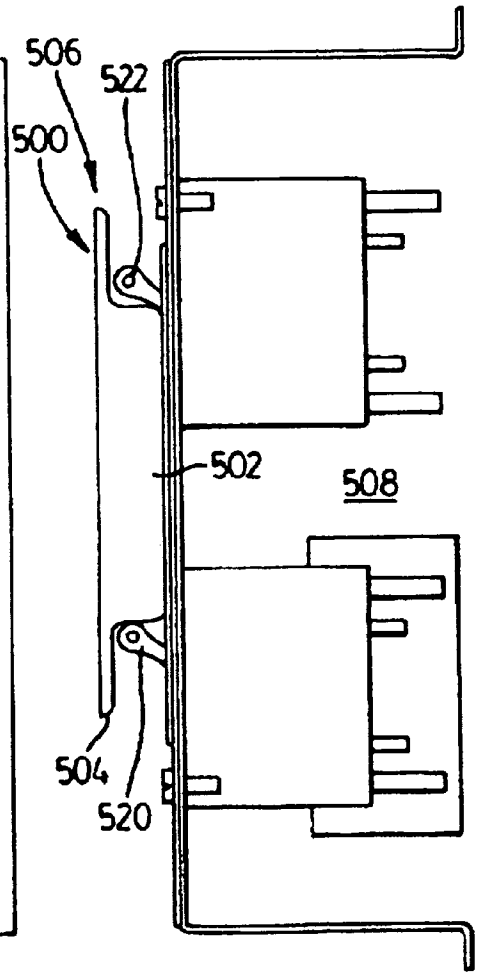
FIG. 66 is a side view of the breaker switch assembly of FIG. 65.
Figure 65:
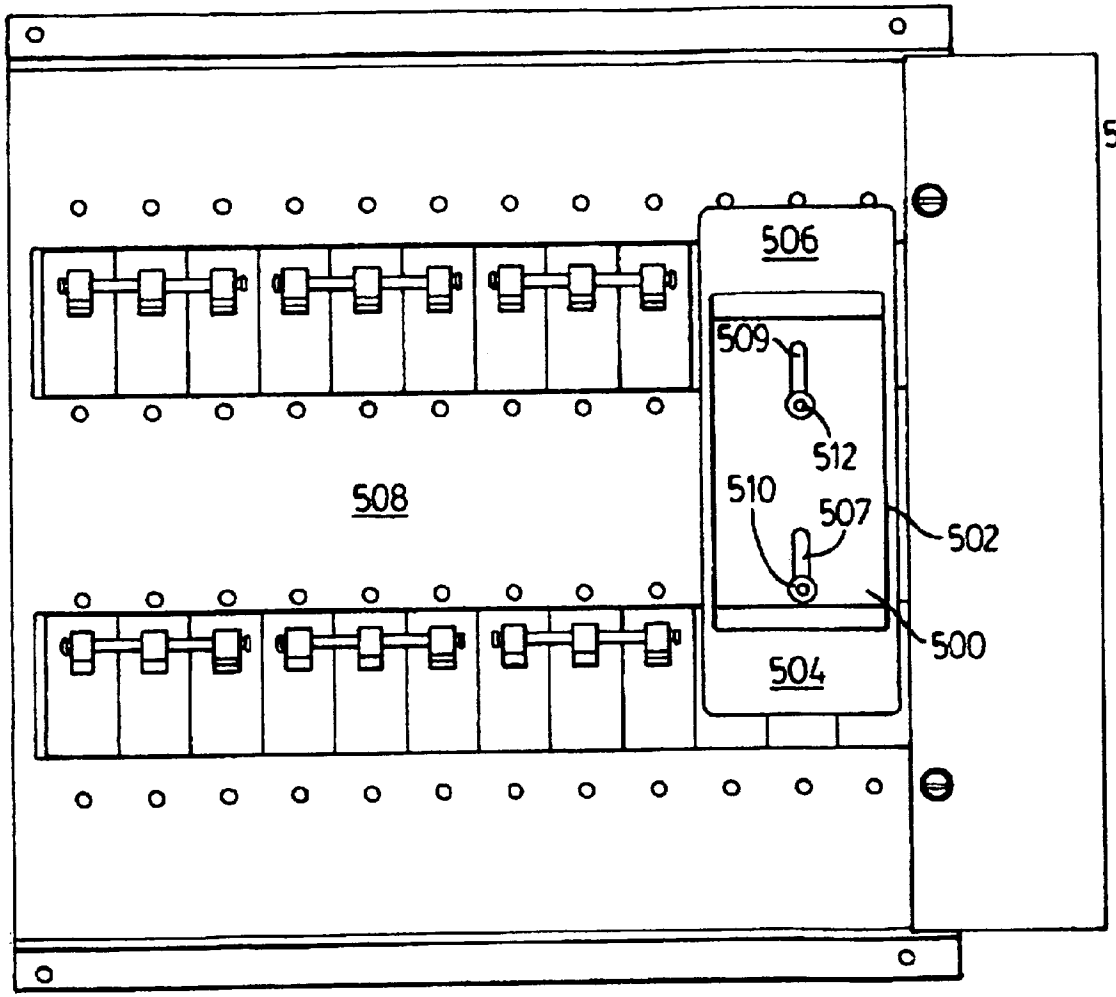
FIG. 65 is a front view of a breaker switch assembly, showing a switch interlock apparatus, according to another alternative embodiment of the invention.
Figure 67:
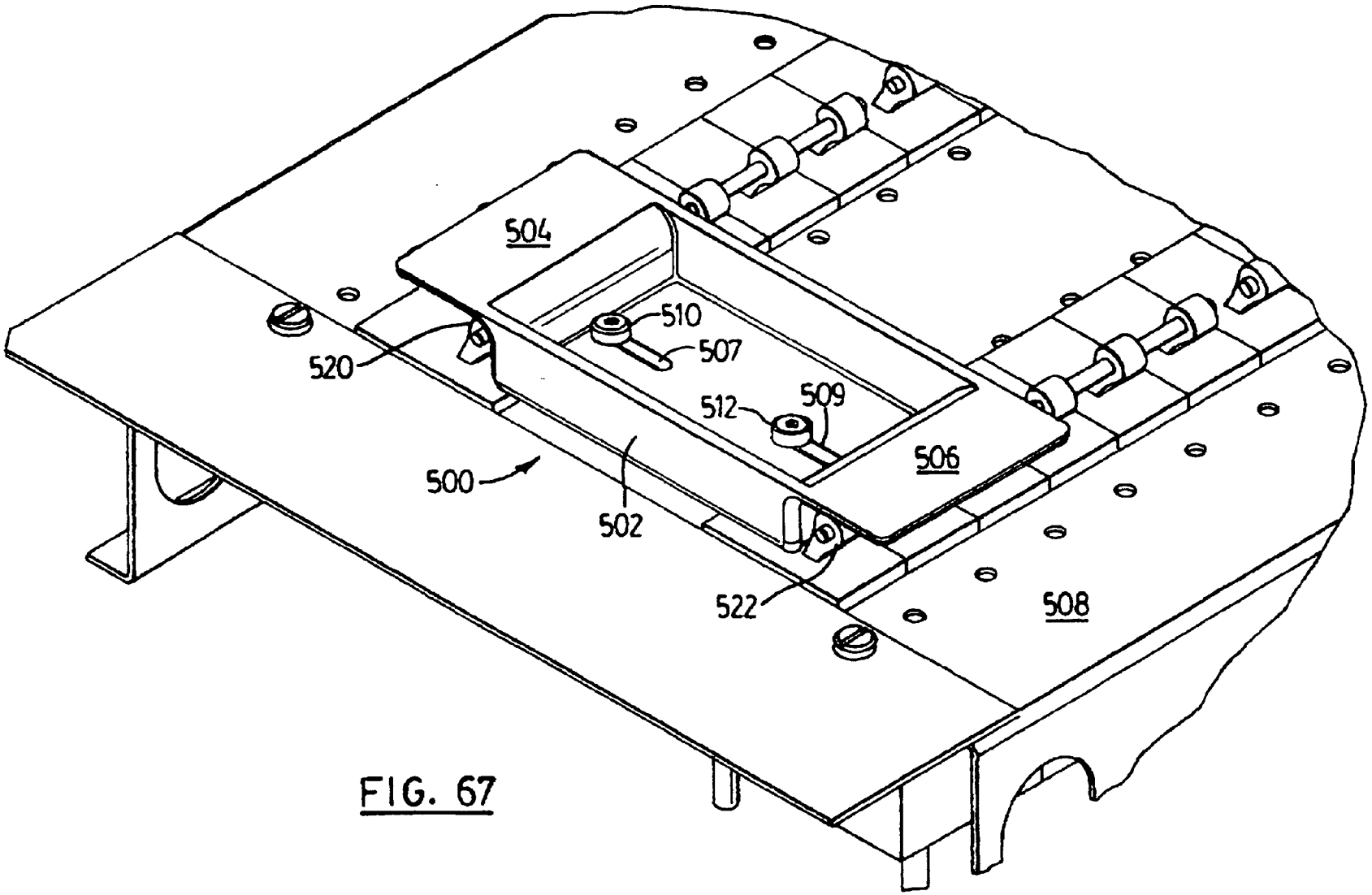
FIG. 67 is a perspective view of the breaker switch assembly of FIG. 65.
Figure 68:
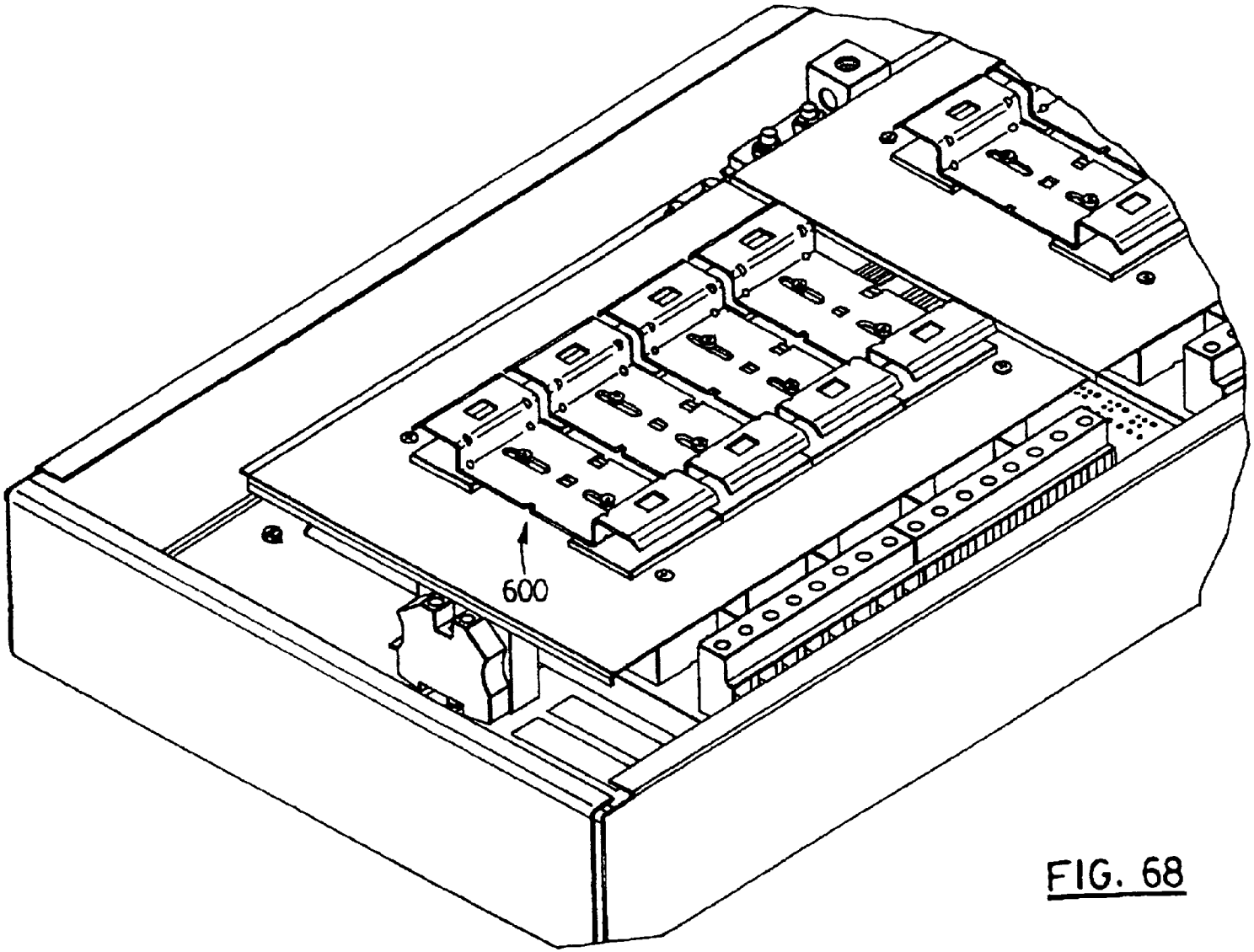
FIG. 68 is a perspective view of a breaker switch assembly, showing a switch interlock apparatus, according to another alternative embodiment of the invention.
Figure 69:
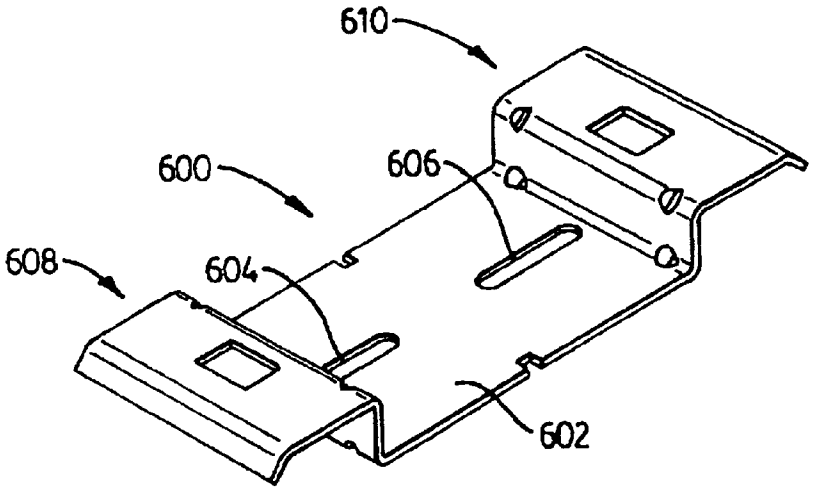
FIG. 69 is a perspective view of a reciprocating interlock member according to another alternative embodiment of the invention.
Figure 72:
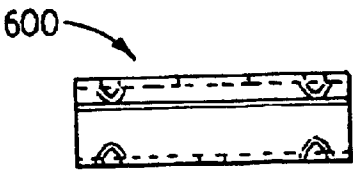
FIG. 72 is an end elevation of the reciprocating interlock member of FIG. 69.
Figure 70:
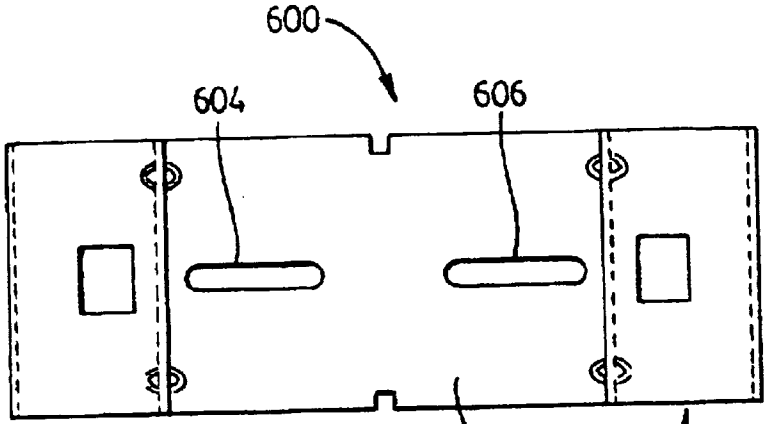
FIG. 70 is a top view of the reciprocating interlock member of FIG. 69.
Figure 71:
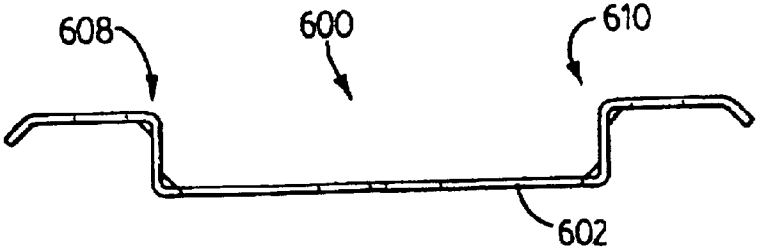
FIG. 71 is a side elevation of the reciprocating interlock member of FIG. 69.
Figure 73:
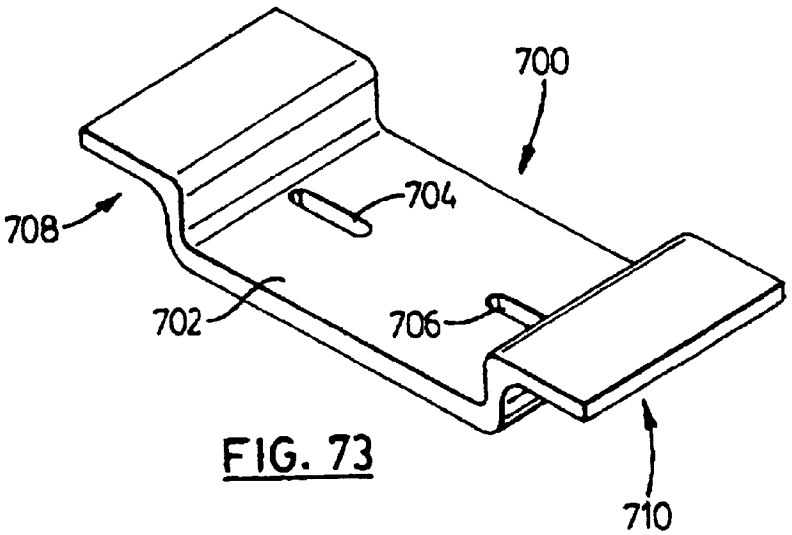
FIG. 73 is a perspective view of a reciprocating interlock member according to another alternative embodiment of the invention.
Figure 76:
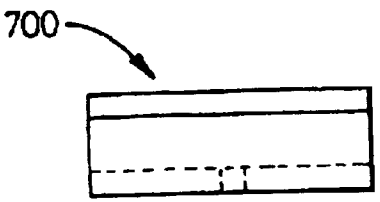
FIG. 76 is an end elevation of the reciprocating interlock member of FIG. 73.
Figure 74:
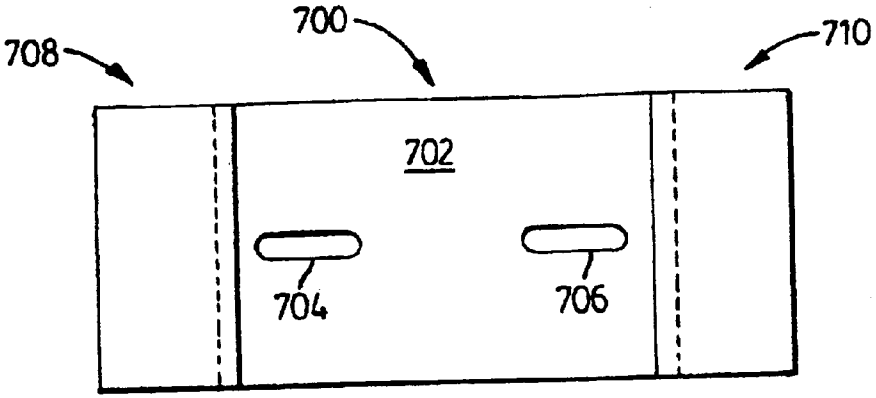
FIG. 74 is a top view of the reciprocating interlock member of FIG. 73.
Figure 75:
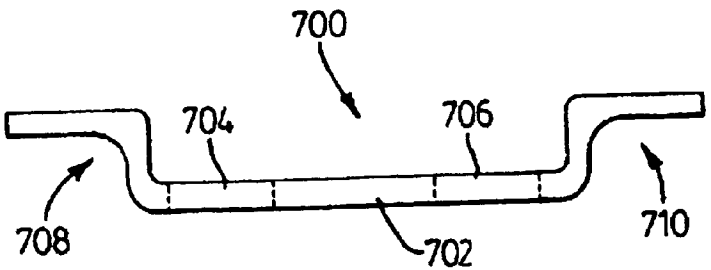
FIG. 75 is a side elevation of the reciprocating interlock member of FIG. 73.

Yet another embodiment of switch interlock apparatus is illustrated in FIGS. 65–67, which show a wide reciprocating interlock member 500, which may be fabricated of molded plastic, or drawn or stamped metal. Reciprocating interlock member 500 is in the form of a generally rectangular trough 502, having two flanges 504, 506, extending from the ends of the trough 502. The bottom of trough 502 includes two elongated slots 507, 509, through which interlock member 500 may be affixed to switch block 508 by two bolts or screws 510, 512, that are received in suitable bores in switch block 508. Again, the length of trough 502 will be selected so that it can only fit between switch handles 520, 522, when one or both are in the "Off" position.

Yet another embodiment is shown in FIGS. 68–72, which show reciprocating interlock member 600, which includes longitudinal central web 602, with two elongated slots 604, 606; and two elevated leg webs 608, 610. Preferably, interlock member 600 may be employed with a mounting bracket, such as mounting bracket 102 previously described, or a frame such as frame 202, such that the screws or bolts will engage the bracket or frame, instead of the switch block, although, if desired, interlock member 600 may be affixed through direct use of bolts/screws directly into the faces of the breaker switch block. Leg webs 608, 610 may be angled slightly, to actually "cover" the switch handles (not shown). Reciprocating interlock member 600 is preferably formed from stamped metal.

A variation of the interlock member of FIGS. 68–72 is shown in FIGS. 73–76, wherein interlock member 700 has a shape which is generally similar to that of interlock member 600. Interlock member 700, includes longitudinal central web 702, with two elongated slots 704, 706; and two elevated leg webs 708, 710. Preferably, interlock member 700 may be employed with a mounting bracket, such as mounting bracket 102 previously described, or a frame such as frame 202, such that the screws or bolts will engage the bracket or frame, instead of the switch block, although, if desired, interlock member 700 may be affixed through direct use of bolts/screws directly into the faces of the breaker switch block. Reciprocating interlock member 700 is preferably formed from machined or molded plastic.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A switch interlock apparatus, for functionally interconnecting the handles of functionally and physically paired switches mounted in tandem on a switch panel, the switch panel having a front face and a housing portion disposed distal to the front face, wherein the handles are arranged in tandem to pivot in a common plane about parallel, spaced apart axes, such that when each handle is in its respective "OFF" position, the handles are pivoted away from one another and when each handle is in its respective "ON" position, the handles are pivoted toward one another, the switch interlock apparatus comprising:

an elongated interlock member, having a longitudinal axis and first and second ends;

at least one fastener structure disposed on the elongated interlock member, for enabling slidable mounting of the elongated interlock member in juxtaposed relation to the front face of a switch panel;

a switch handle engagement surface, disposed on each end of the elongated interlock member;

a mounting bracket operably configured to be attached to a switch panel housing, for slidably mounting the elongated interlock member in said juxtaposed relation to the front face of a switch panel, without attachment of the elongated interlock member to the front face, the mounting bracket further being operably configured for restrainably maintaining functionally and physically paired switches on a switch panel, the elongated interlock member being mounted, relative to the switches, so as to move in the direction of its longitudinal axis, parallel to said common plane of movement of the handles of the paired switches.

2. The switch interlock apparatus, according to claim 1, wherein the elongated interlock member comprises a substantially U-shaped member, including a substantially planar elongated portion having two ends, and an upraised switch handle engaging leg at each end.

3. The switch interlock apparatus, according to claim 2, wherein the at least one fastener structure comprises an elongated slot in the substantially planar longitudinal portion of the interlock member.

4. The switch interlock apparatus according to claim 1, wherein the mounting bracket comprises:

an interlock member support leg operably configured to extend across the front face of a switch; and an attachment leg, at least indirectly connected thereto, configured for attachment to a switch housing.

5. The switch interlock apparatus according to claim 4, wherein the interlock member support leg further comprises:

at least one stabilizer bar emanating from a side edge of the interlock member support leg, operably configured for bearing against a front face of a switch, toward preventing twisting of the interlock member support leg relative to said front face.

6. A switch interlock apparatus, for functionally interconnecting the handles of functionally and physically paired switches mounted in tandem on a switch panel, the switch panel having a front face and a housing portion disposed distal to the front face, wherein the handles are arranged in tandem to pivot in a common plane about parallel, spaced apart axes, such that when each handle is in its respective "OFF" position, the handles are pivoted away from one another and when each handle is in its respective "ON" position, the handles are pivoted toward one another, the switch interlock apparatus comprising:

a mounting frame, operably configured to interlockingly engage peripheral regions of front face areas of physically paired switches, without the use of separate fasteners;

a mounting post disposed on the mounting frame;

an interlock member, slidably mounted on the mounting post for reciprocating movement relative to the mounting frame, and configured so that when the mounting frame is mounted on the faces of paired switches, the switch handles are precluded from simultaneously occupying their respective "ON" positions, and movement of a first switch handle from its "OFF" position, toward its "ON" position, causes the interlock member to push a second switch handle from its "ON" position, to its "OFF" position, prior to the first switch handle arriving at its "ON" position, the elongated interlock member being mounted, relative to the switches, so as to move in the direction of its longitudinal axis, parallel to said common plane of movement of the handles of the paired switches.

7. The switch interlock apparatus, according to claim 6, wherein the interlock member has a shape in the form of a "U"-shaped channel, comprising a planar central web and two planar leg webs extending substantially perpendicular thereto, the central web having an elongated slot therein.

8. The switch interlock apparatus according to claim 7, further comprising:

the mounting post being hollow and internally threaded, a fastener extending through the elongated slot and into a complementary fastener receiving aperture disposed in the mounting post.

9. The switch interlock apparatus according to claim 7, further comprising:

the mounting post being externally threaded and extending through the elongated slot, and a fastener in the form of an internally threaded nut maintains the interlock member in position.

10. The switch interlock apparatus according to claim 6, further comprising:

at least two guide members disposed on the mounting frame at transversely spaced apart positions, so that the mounting post is disposed substantially equidistantly between the at least two guide members, for guiding the interlock member during its reciprocating movement.

11. The switch interlock apparatus according to claim 6, further comprising at least one resiliently movable spring clip member operably disposed on the mounting frame for interlockingly engaging a peripheral portion of a switch face.

12. A switch interlock apparatus, for functionally interconnecting the handles of functionally and physically paired switches mounted in tandem on a switch panel, the switch panel having a front face and a housing portion disposed distal to the front face, wherein the handles are arranged in tandem to pivot in a common plane about parallel, spaced apart axes, such that when each handle is in its respective "OFF" position, the handles are pivoted away from one another and when each handle is in its respective "ON" position, the handles are pivoted toward one another, the switch interlock apparatus comprising:

a mounting frame, operably configured to interlockingly engage peripheral regions of front face areas of physically paired switches, without the use of separate fasteners;

a mounting post disposed on the mounting frame;

an interlock member, slidably mounted on the mounting post for reciprocating movement relative to the mounting frame, and configured so that when the mounting frame is mounted on the faces of paired switches, the switch handles are precluded from simultaneously occupying their respective "ON" positions, and movement of a first switch handle from its "OFF" position, toward its "ON" position, causes the interlock member to push a second switch handle from its "ON" position, to its "OFF" position, prior to the first switch handle arriving at its "ON" position, the interlock member has a shape in the form of a "U"-shaped channel, comprising a planar central web and two planar leg webs extending substantially perpendicular thereto, the central web having an elongated slot therein, wherein the interlock member is in the configuration of an elongated "U"-shaped channel, in which the "U"-shaped channel is inverted relative to the mounting post, so that the mounting post extends between the leg webs, and in which the "U"-shaped channel is oriented such that the leg webs extend longitudinally, with respect to an axis extending between the switch handles, when the switch interlock apparatus is mounted on a pair of switches arranged in tandem, wherein end edge portions of the central web of the "U"-shaped channel engage the switch handles during reciprocating movement of the interlock member.

13. A switch interlock apparatus, for functionally interconnecting the handles of functionally and physically paired switches mounted in tandem on a switch panel, the switch panel having a front face and a housing portion disposed distal to the front face, wherein the handles are arranged in tandem to pivot in a common plane about parallel, spaced apart axes, such that when each handle is in its respective "OFF" position, the handles are pivoted away from one another and when each handle is in its respective "ON" position, the handles are pivoted toward one another, the switch interlock apparatus comprising:

a mounting frame, operably configured to interlockingly engage peripheral regions of front face areas of physically paired switches, without the use of separate fasteners;

a mounting post disposed on the mounting frame;

an interlock member, slidably mounted on the mounting post for reciprocating movement relative to the mounting frame, and configured so that when the mounting frame is mounted on the faces of paired switches, the switch handles are precluded from simultaneously occupying their respective "ON" positions, and movement of a first switch handle from its "OFF" position, toward its "ON" position, causes the interlock member to push a second switch handle from its "ON" position, to its "OFF" position, prior to the first switch handle arriving at its "ON" position, the interlock member has a shape in the form of a "U"-shaped channel, comprising a planar central web and two planar leg webs extending substantially perpendicular thereto, the central web having an elongated slot therein, wherein the interlock member is in the configuration of a widened, truncated "U"-shaped channel, in which the channel is oriented such that the leg webs extend transversely with respect to an axis extending between the switch handles, when the switch interlock apparatus is mounted on a pair of switches arranged in tandem, wherein portions of the leg webs of the "U"-shaped channel engage the switch handles during reciprocating movement of the interlock member.

14. The switch interlock apparatus, according to claim 13, wherein the interlock member has a shape in the form of a "U"-shaped channel, comprising a central web and two planar leg webs extending substantially perpendicular thereto, the central web having an elongated slot therein.

15. A switch interlock apparatus, for functionally interconnecting the handles of functionally and physically paired switches mounted in tandem on a switch panel, the switch panel having a front face and a housing portion disposed distal to the front face, wherein the handles are arranged in tandem to pivot in a common plane about parallel, spaced apart axes, such that when each handle is in its respective "OFF" position, the handles are pivoted away from one another and when each handle is in its respective "ON" position, the handles are pivoted toward one another, the switch interlock apparatus comprising:

a mounting frame, operably configured to interlockingly engage peripheral regions of front face areas of physically paired switches, without the use of separate fasteners;

an interlock member, slidably mounted relative to the mounting frame for reciprocating movement relative thereto, and configured so that when the mounting frame is mounted on the faces of paired switches, the switch handles are precluded from simultaneously occupying their respective "ON" positions, and movement of a first switch handle from its "OFF" position, toward its "ON" position, causes the interlock member to push a second switch handle from its "ON" position, to its "OFF" position, prior to the first switch handle arriving at its "ON" position; and an interlock member mounting and guide structure, operably disposed on the mounting frame, for enabling capture of the interlock member between the interlock member mounting and guide structure, and front face surfaces of the mounted in tandem switches and facilitating reciprocating longitudinal movement of the interlock member, when the switch interlock apparatus is mounted on the mounted in tandem switches, the elongated interlock member being mounted, relative to the switches, so as to move in the direction of its longitudinal axis, parallel to said common plane of movement of the handles of the paired switches.

16. The switch interlock apparatus according to claim 15, further comprising at least one resiliently movable spring clip member operably disposed on the mounting frame for interlockingly engaging a peripheral portion of a switch face.

17. The switch interlock apparatus according to claim 15, wherein the interlock member is in the configuration of a widened, truncated "U"-shaped member, in which the member is oriented such that the leg webs extend transversely with respect to an axis extending between the switch handles, when the switch interlock apparatus is mounted on a pair of switches arranged in tandem, wherein portions of the leg webs of the "U"-shaped channel engage the switch handles during reciprocating movement of the interlock member.

18. A switch interlock apparatus, for functionally interconnecting the handles of functionally and physically paired switches mounted in tandem on a switch panel, the switch panel having a front face and a housing portion disposed distal to the front face, wherein the handles are arranged in tandem to pivot in a common plane about parallel, spaced apart axes, such that when each handle is in its respective "OFF" position, the handles are pivoted away from one another and when each handle is in its respective "ON" position, the handles are pivoted toward one another, the switch interlock apparatus comprising:

an interlock member, the interlock member having an elongated central planar web having a longitudinal axis, the interlock member configured to be mounted relative to the mounted in tandem switches such that the longitudinal axis of the central planar web extends parallel to an axis extending between the switch handles, when the switch interlock apparatus is mounted on a pair of switches arranged in tandem;

the interlock member further having two "L"-shaped leg webs extending from opposite ends of the central planar web, each leg web including a truncated connecting web portion extending at an angle to the central planar web, and a switch handle engaging web portion, extending substantially parallel to the central planar web, the elongated interlock member being mounted, relative to the switches, so as to move in the direction of its longitudinal axis, parallel to said common plane of movement of the handles of the paired switches.

19. The switch interlock apparatus according to claim 18, wherein the switch panel has a front face and a housing portion disposed distal to the front face, the switch interlock apparatus further comprising:

a mounting bracket operably configured to be attached to a switch panel housing, for slidably mounting the elongated interlock member in said juxtaposed relation to the front face of a switch panel, without attachment of the elongated interlock member to the front face, the mounting bracket further being operably configured for restrainably maintaining functionally and physically paired switches on a switch panel.

20. The switch interlock apparatus according to claim 18, wherein the switch interlock member is mountable directly to front face surfaces of the mounted in tandem switches, for slidable movement relative thereto.

* * * * *